United States Patent [19]

Miyata et al.

[11] Patent Number: 4,999,674

[45] Date of Patent: Mar. 12, 1991

[54] IMAGE FORMING APPARATUS HAVING SYNTHETIC RECORDING FUNCTIONS

[75] Inventors: Masanori Miyata, Yokohama; Yutaka Komiya; Shinichi Nakamura, both of Tokyo; Masayuki Hirose, Yokohama; Toshihiko Mori; Tomobumi Nakayama, both of Tokyo, all of Japan

[73] Assignee: Canon Kabushiki Kaisha, Tokyo, Japan

[21] Appl. No.: 315,844

[22] Filed: Feb. 27, 1989

Related U.S. Application Data

[60] Division of Ser. No. 87,962, Aug. 17, 1987, Pat. No. 4,825,250, which is a continuation of Ser. No. 770,190, Aug. 28, 1985, abandoned.

[30] Foreign Application Priority Data

| | | | |
|---|---|---|---|
| Aug. 30, 1984 | [JP] | Japan | 59-182283 |
| Sep. 4, 1984 | [JP] | Japan | 59-184861 |
| Sep. 4, 1984 | [JP] | Japan | 59-184862 |
| Sep. 4, 1984 | [JP] | Japan | 59-184863 |
| Sep. 4, 1984 | [JP] | Japan | 59-184864 |
| Oct. 2, 1984 | [JP] | Japan | 59-206626 |
| Oct. 2, 1984 | [JP] | Japan | 59-206627 |

[51] Int. Cl.[5] ..... G03G 15/00

[52] U.S. Cl. ..... 355/218; 355/235

[58] Field of Search ..... 355/8, 7, 14 R, 23–26, 355/218, 233, 235, 244, 319

[56] References Cited

U.S. PATENT DOCUMENTS

| | | | |
|---|---|---|---|
| 4,017,173 | 4/1977 | Komori et al. | 355/8 |
| 4,098,551 | 7/1978 | Komori et al. | 355/26 X |
| 4,595,273 | 6/1986 | Watanabe et al. | 355/8 X |
| 4,659,207 | 4/1987 | Maekawa | 355/8 |

*Primary Examiner*—Joan H. Pendegrass

*Attorney, Agent, or Firm*—Fitzpatrick, Cella, Harper & Scinto

[57] ABSTRACT

There is an image forming apparatus in which images of a plurality of originals set on the original plate glass are individually exposed, scanned and read, and the read images are synthesized and recorded at arbitrary positions on a recording paper. This apparatus also has a device to recor : the images on the front and back surfaces of the :ecording paper. The synthetic recording and the front and back surface recording can be arbitrarily switched and selected. This apparatus is provided with a trimming function to erase unnecessary image portions of the images, a masking function to prevent the shaded portions from being recorded on an paper, and the image shift function to adjust the synthesizing positions of the images on the recording paper for every image. In the serial page copy mode adapted for book images, the masking function is automatically selected and the recording positions on the front and back surfaces of the recording paper are aligned to either one of the right and left sides of the paper, so that the binding margins can be secured on one selected side of the paper. The masking function is released when the serial page copy mode is released.

12 Claims, 31 Drawing Sheets

IMAGE FORMING APPARATUS HAVING SYNTHETIC RECORDING FUNCTIONS

This application is a division of allowed application Ser. No. 087,962 filed Aug. 17, 1987, now U.S. Pat. No. 4,825,250 , which was a continuation of Ser. No. 770,190, filed Aug. 28, 1985, now abandoned.

BACKGROUND OF THE INVENTION

1. Field of the Invention

The present invention relates to a two-sided or multiple copy image forming apparatus.

2. Description of the Prior Art

Hitherto, in the case of synthesizing two images on a sheet of transfer paper, one original paper is set on the original plate and copied, thereafter it is removed and another original paper has to be again set on the original plate and copied again by a manual operation. Therefore, there are drawbacks such that it takes time for the exchange of originals and for copying by manual operation and it is possible to erroneously insert paper in the wrong direction for copying by manual operation.

On one hand, in the case where at least one original includes unnecessary portions, this original has to be copied after the unnecessary portions were manually cut or covered using paper or the like, so that it is very troublesome.

In addition, in case of changing the position of the image on the transfer paper, it is difficult to set the original at the necessary position, resulting in working inefficiency and causing failure of the apparatus.

In the case of synthesizing two images on a sheet of transfer paper with variable magnifications, respectively, one original is set on the original plate and copied with a desired magnification, thereafter it is removed and another original has to be set on the original plate and copied again by manual operation. Thus, there are drawbacks such that it takes time for the exchange of originals and for manual operation and it is possible to erroneously insert a paper in the wrong direction upon manual operation.

On one hand, in recent years, the function of making a blank space for binding the margin has been considered. However, according to this function, such a blank can be made on only either one side (the side of the front edge of the recording paper or the side of the rear edge thereof) by a single operation. Therefore, in case of recording two images on both front and back surfaces of one recording paper, there is a drawback such that the blank spaces for the binding margins will have been made to the left on the surface front and to the right on the back surface of the recording paper and in the opposite directions when the recorded image is seen from the direction of the other surfaces of the paper.

In case of copying originals of a book or the like using the serial page copy function by which the right and left pages are individually read, a black frame is caused on the corner sides of the images; therefore, to prevent such a black frame, a masking function using the size of the original as a reference has been provided. However, either the serial page copy function or the masking function has to be individually selected, causing drawbacks such as the omission of the selection or non-selection of the masking function, and the delay in pressing the masking function selection key, and the deterioration of efficiency and picture quality.

On the other hand, image forming apparatus have been developed in which two images are synthesized and recorded on one side of one recording paper or recorded on the front and back surfaces of one recording paper.

It is also known where the image shifting operation is performed, to make the binding margin in such an apparatus. For this purpose, the operator selects the image shifting function if necessary and releases this function if it is unnecessary. However, the operator can have a lapse of judgement or one forget the selection or release of the image shifting function, resulting in a case of miscopying. In addition, as well as the selection of the synthetic recording mode or the two-sided recording mode, the image shifting operation has to be selected or released every time, so that the operating efficiency is poor.

SUMMARY OF THE INVENTION

It is an object of the present invention to eliminate the foregoing drawbacks. An image forming apparatus is provided which may independently scan and form images of two different regions of an original. The images formed of the two regions may be at two different magnifications, shifted independently of each other and formed on two different sides of a recording medium. The foregoing operations may all be performed automatically without replacement of the original.

Another object of the invention is to improve an image forming apparatus.

Still another object of the invention is to provide an image forming apparatus which can automatically perform the overlay of a plurality of images set on the original plate.

Still another object of the invention is to provide an image forming apparatus which can automatically erase the unnecessary portions of a plurality of images set on the original plate and then automatically perform the overlay of those images.

Still another object of the invention is to provide an image forming apparatus which can automatically perform the overlay of a plurality of images set on the original plate and at the same time which can change the magnifications of those images.

Still another object of the invention is to provide an image forming apparatus which can automatically perform the overlay of a plurality of images set on the original plate and at the same time which can automatically and individually adjust the positions of images on paper.

Still another object of the invention is to provide an image forming apparatus which can accurately make the blank spaces for binding margins in the case of recording two images on the front and back surfaces of one recording paper.

Still another object of the invention is to provide an image forming apparatus which can automatically select the masking function when the serial page copy function is selected and which can release the masking function as well when the serial page copy function is released.

The present invention pertains to an image forming apparatus including a platen for placing first and second originals side by side thereon and scanning means for scanning the first and second originals placed on the platen side by side. A first scanning operation of the scanning means moves in a first direction in order to scan the first original and then moves in a second direction, and in a second scanning operation the scanning means moves in the first direction in order to scan the second original. An image forming means forms on a recording medium both a first latent image corresponding to the scanned first original and a second latent image corresponding to the scanned original. A developing means develops the first and second latent imaged formed on said recording medium. A charge control means for, in the second scanning operation of the scanning means, causes a predetermined area of the recording medium corresponding to an area overlapping upon the first scanning operation to become a non-charge state prior to a development of the second latent image.

Other objects, features and advantages of the present invention will become apparent from the following detailed description and the appended claims with reference to the accompanying drawings.

BRIEF DESCRIPTION OF THE DRAWINGS

FIGS. 4-1 to 4-3 are flowcharts showing a control procedure;

FIGS. 8-1 to 8-5, 11-1 to 11-5, 13-1 to 13-4, 15-1 to 15-5, and 17-1 to 17-3 are flowcharts showing other embodiments of control procedures;

DETAILED DESCRIPTION OF THE PREFERRED EMBODIMENTS

One embodiment of the present invention will now be described in detail hereinbelow with reference to the drawings.

Figure 1:
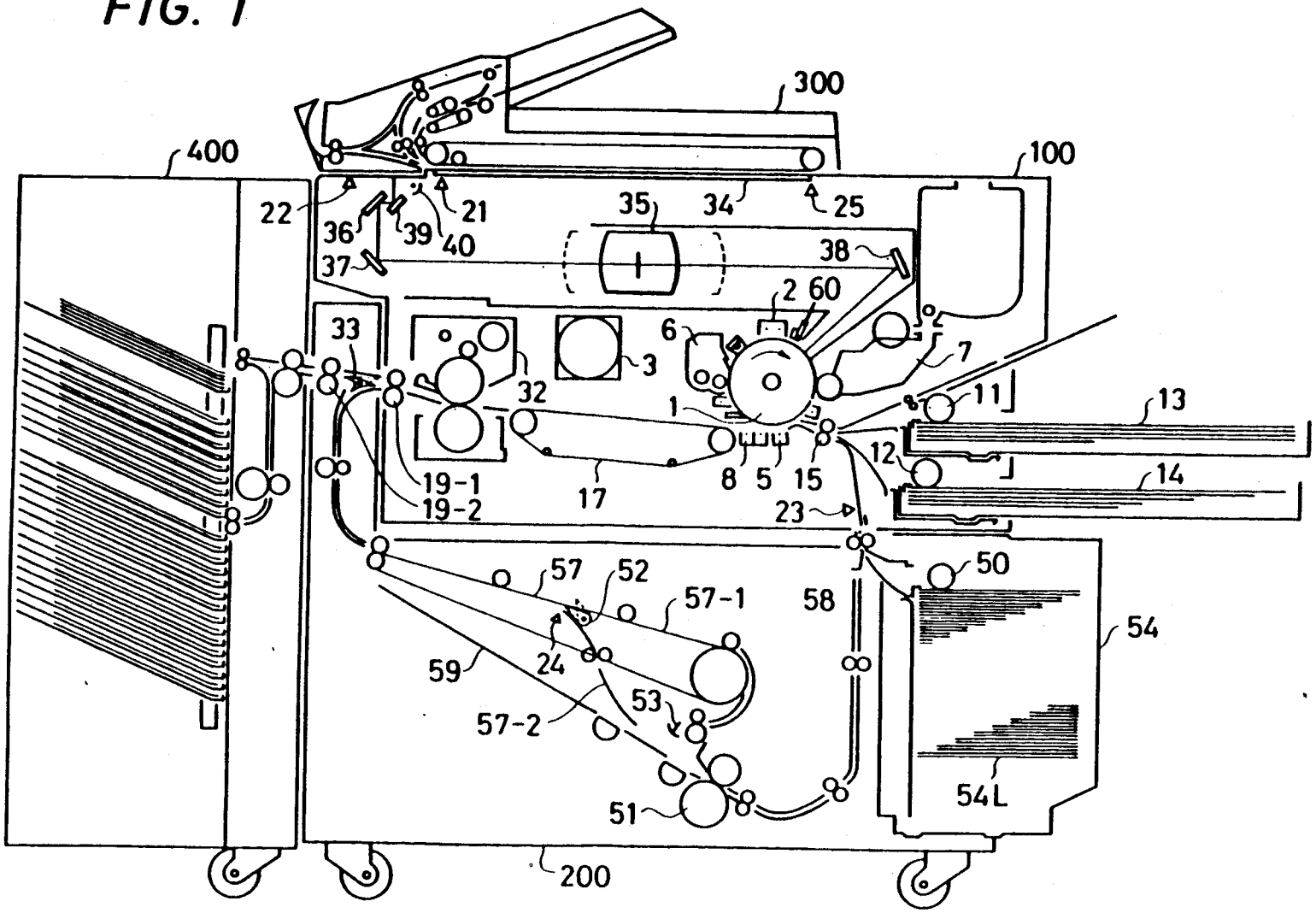
FIG. 1 is a cross sectional view showing one embodiment of an apparatus to which the present invention is applied.
Figure 2A:
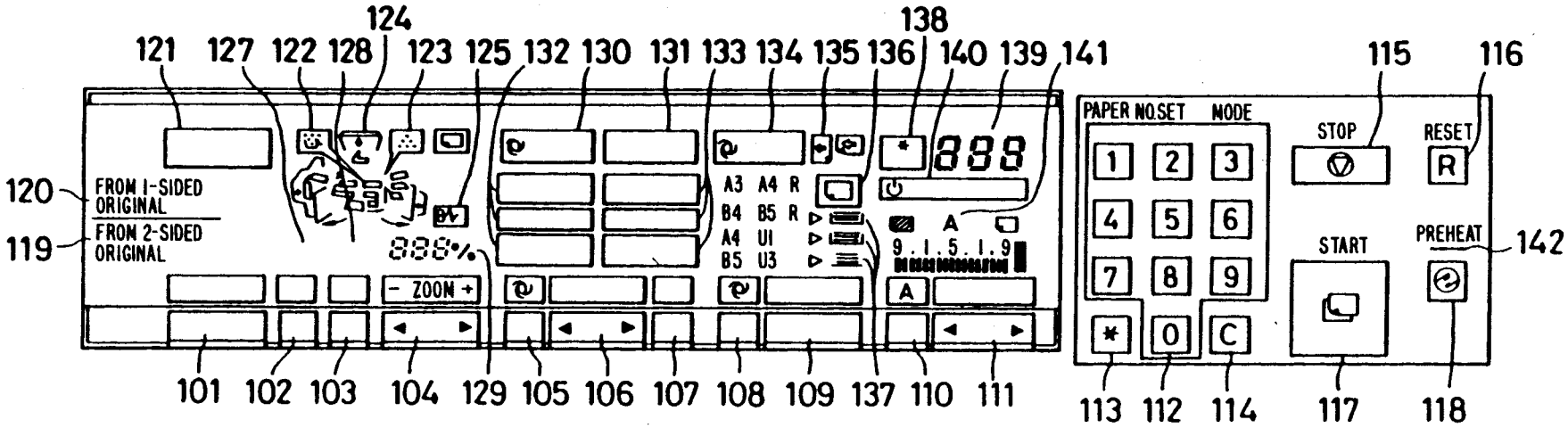
FIGS. 2-A and 2-B are front views showing an overall operating section of the apparatus in FIG. 1.
Figure 2B:
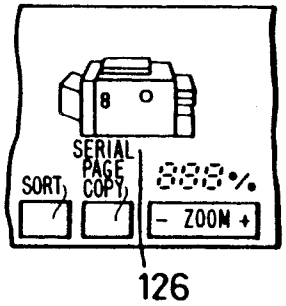

FIG. 1 is a cross sectional view showing an overall arrangement of one embodiment of an image forming apparatus to which the present invention is applied.

In the diagram, the surface of a drum 1 consists of a conductive material and a seamless photo sensitive material using a photo conductive material. The drum 1 is rotatably and axially supported and starts rotating in the direction indicated by an arrow by a main motor 3 which is made operative in response to the depression of a copy start key. After completion of a predetermined amount of rotation of the drum 1 and of a potential control process (preprocess), an original set on an original plate glass 34 is illuminated by an illuminating lamp 40 constituted integrally with a first scanning mirror 39. The reflected light from the original are formed as an image on the drum 1 via the first mirror 39, a second mirror 36, a third mirror 37, a lens 35, and a fourth mirror 38.

The drum 1 is corona-charged by a high voltage unit 2. Thereafter, the image illuminated by the exposure lamp 40 is exposed by means of a slit, so that an electrostatic latent image is formed on the drum 1 in a well-known manner. A non-scan exposure lamp 60 erases the surface charges of the drum in the non-image region and thereby preventing an unnecessary additional amount of toner from being deposited on the drum. This non-scan exposure lamp is also used to perform the trimming, image shift, etc. In this embodiment, an LED array is used as the non-scan exposure lamp 60.

The latent image on the photo sensitive drum 1 is then developed by a developing roller of a developing device 7 and is visualized as a toner image. This toner image is transferred by a transfer electrifier 5.

Transfer papers set in an upper cassette 13 or a lower cassette 14 are sent one by one into the main body of the apparatus by means of a feed roller 11 or 12. This transfer paper is sent by a registration roller 15 in the direction of the drum 1 at an accurate timing such that the leading edge of the latent image coincides with the edge of the transfer paper. However, those edges are not necessarily made coincident in case of performing the image shift. Thereafter, the transfer paper passes through the gap between the transfer electrifier 5 and the drum 1, so that the toner image on the drum 1 is transferred onto the paper.

After completion of the transfer, the transfer paper is separated from the drum 1 by a separating electrifier 8 and is led to a fixing device 32 by a conveying belt 17, by which the transfer paper is pressed and heated, so that it is fixed. Thereafter, the transfer paper is delivered to the outside of the apparatus by discharge rollers 19-1 and 19-2.

The drum 1 after completion of the transfer is continuously rotated and the surface is cleaned by means of a cleaning device 6 constituted by a cleaning roller and an elastic blade.

A pedestal 200 can be detached from a main body 100 and has a deck 54 capable of enclosing 2000 transfer papers and a middle tray 59 for two-sided copying. A lifter 54L of the deck 54 can go up in accordance with the quantity of transfer papers such that the transfer paper can always come into contact with a feed roller 50.

When the apparatus is operated in the two-sided copy mode or the multiple copy mode for serial page copies, which will be explained hereinafter, a delivery flapper 33 of the main body 100 is first lifted up as shown by the broken lines to thereby lead the copied transfer paper to the side of the pedestal 200 and to store on the middle tray 59 through a conveying path 57 of the pedestal 200. In the two-sided copy mode, a multiple flapper 52 is put down to a lower position as indicated by the solid lines. While in the multiple copy mode for serial page copies, the multiple flapper 52 is lifted up as indicated by the broken lines. The middle tray 59 can load up to 99 transfer papers. The transfer papers loaded are pressed by a middle copy tray weight 53.

At the time of the back side copy mode or multiple copy mode which is executed next, the transfer papers loaded on the middle copy tray 59 are led one by one from the bottom to the registration roller 15 the apparatus operates in the main body 100 through a conveying path 58 due to the actions of a feed roller 51 and the weight 53.

A circulating original feed apparatus (RDF) 300 can automatically set the two-sided original at the original exposure position.

Further, a sorter 400 sorts the copy papers delivered from the main body.

Figures 1, 4:
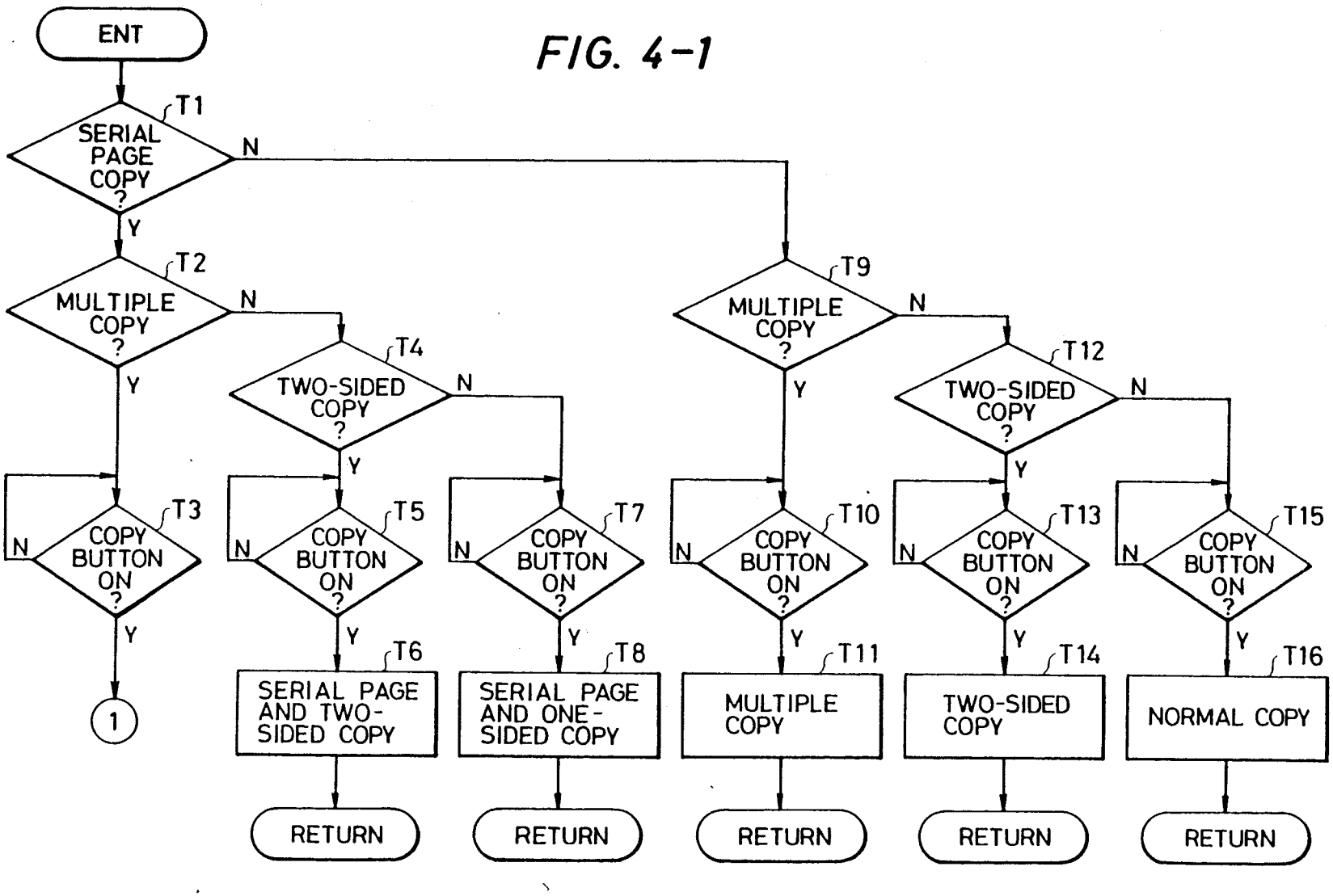
Figures 2, 4:
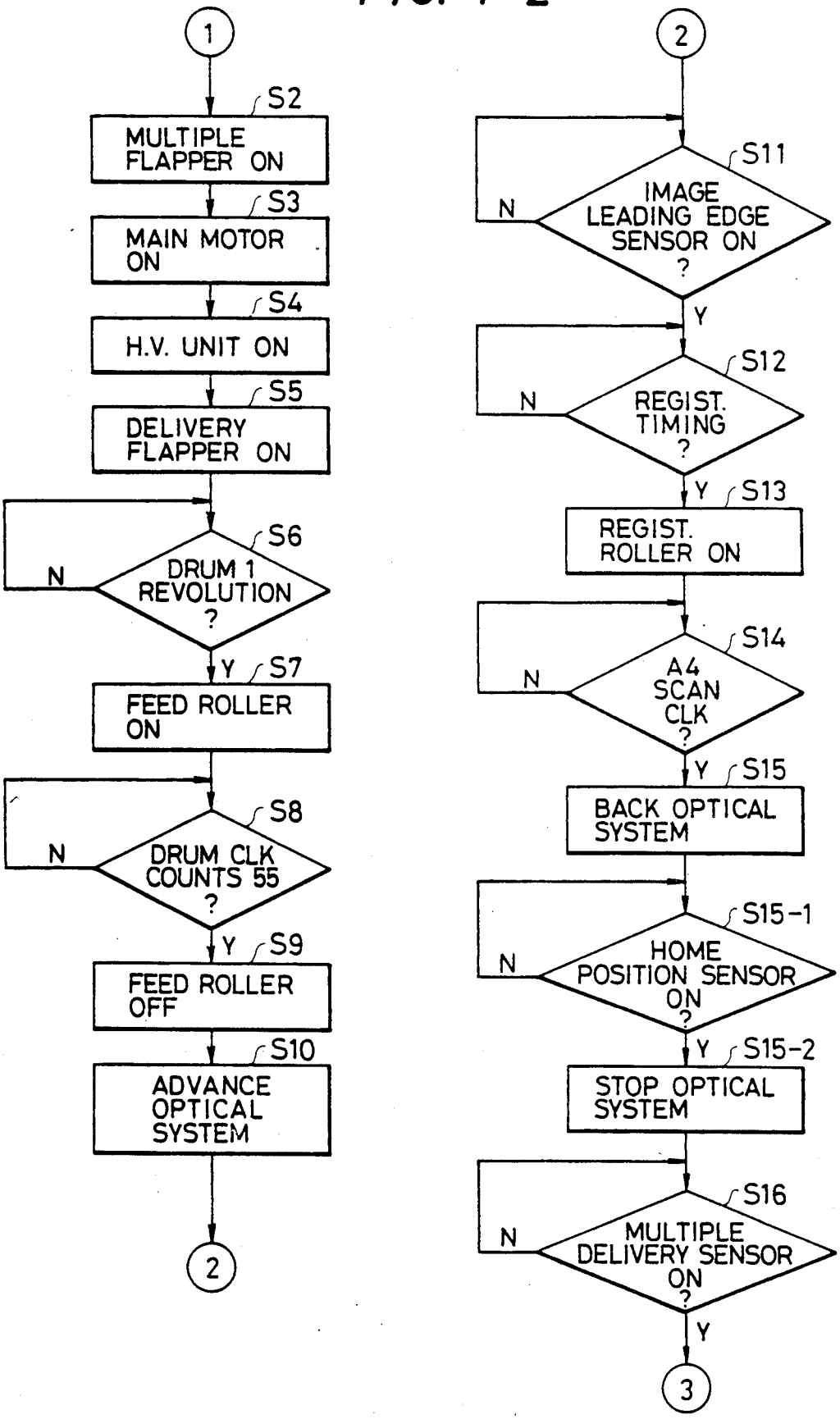
Figures 3, 4:
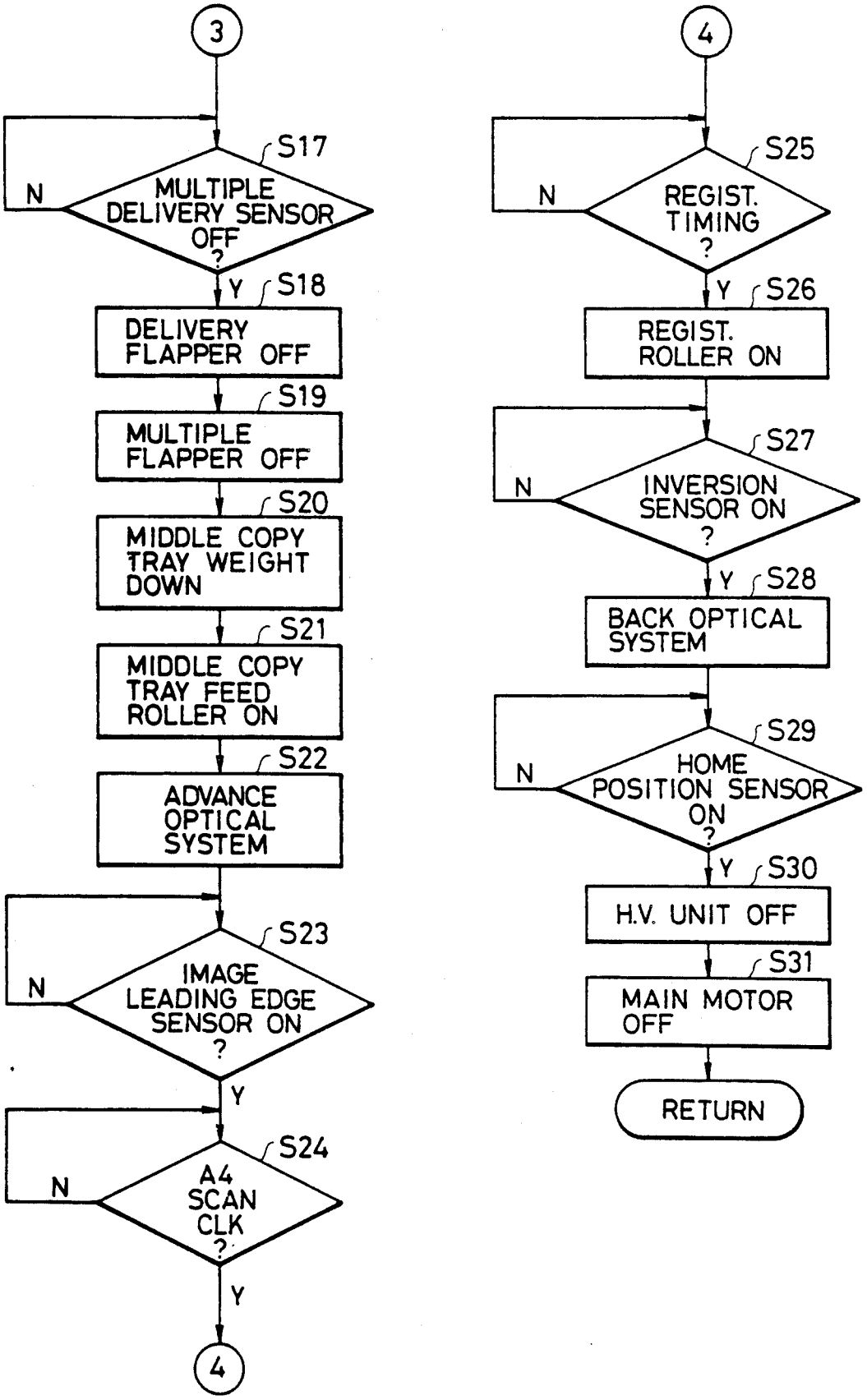

FIGS. 2-a and 2-b are plan views showing an overall operation section of the main body 100.

A two-sided copy key 101 is pressed to perform two-sided copying from a one-sided original, two-sided copying from a two-sided original, or one-sided copying from a two-sided original. Pressing the two-sided key 101 once allows the apparatus to enter the two-sided copy mode for copying a one-sided original. Pressing the key 101 again allows the apparatus to enter the two-sided copy mode for copying a two-sided original. Pressing the key 101 again permits the apparatus to enter the one-sided copy mode for copying a two-sided original. Pressing the key 101 again causes the two-sided copy mode to be released and allows the apparatus to enter the one-sided copy mode for copying a one-sided original.

A sort key 102 is illuminated in the normal mode in the case where the apparatus is equipped with a sorter. The sort key 102 is pressed to release the sorting operation or to allow the apparatus to enter the sorting mode.

A serial page copy key 103 is pressed in the case where two originals set on the original plate or right and left pages of an original such as a book or the like are respectively exposed and scanned and to thereby copy them on different papers.

A zoom key 104 is pressed to designate an arbitrary desired magnification between 64 to 142%.

An automatic magnification key 105 is pressed to automatically reduce or enlarge an original in accordance with the size of copy paper designated.

A standard size magnification key 106 is pressed to designate the reduction or enlargement of the standard size.

A direct copy key 107 is pressed to perform copying of an equal magnification (original size).

An automatic paper selection key 108 is pressed to allow the apparatus to automatically select the optimum copy paper in accordance with the size of original and with the magnification designated.

A cassette selection key 109 is pressed to select either one of the upper cassette, middle cassette, and lower paper deck.

An AE key 110 is pressed to automatically control the copy density to the optimum density by detecting the density of an original or to release the AE mode and switch to the manual control mode.

A copy density key 111 is pressed to manually control the copy density.

A ten-key set 112 is pressed to set the copy quantity. This ten-key is also used to set the * (asterisk) mode or set the coordinates in case of trimming an original or set the shift amount upon image shifting operation.

An * (asterisk) mode setting key 113 is pressed to set the multiple copy mode, trimming mode, image shifting mode, original masking mode, sheet masking mode, or the like.

A clear key 114 is pressed to release the copy quantity set by the ten-key set 112. This clear key is also used to release the * (asterisk) mode.

A stop key 115 is pressed to interrupt the serial copy mode. The copying operation is stopped after the copying operation executed at the time the depression of the stop key 115 was completed.

A reset key 116 is pressed to return the apparatus to the normal mode.

A copy start key 117 is pressed to start the copying operation.

A preheating key 118 is pressed to preheat the machine or release the preheating state. This preheating key is also pressed to return the apparatus to the normal mode from the automatic shut-off state. The term "preheating state" means the state in which the voltages other than the voltage for the heater of the fixing device are turned off.

A two-sided copy display 119 is lit when either one of the two-sided copy mode for copying a two-sided original and the two-sided copy mode for copying a one-sided original is selected.

A one-sided copy display 120 is lit when the one-sided copy mode for copying a two-sided original is selected.

A two-sided mode display 121 is lit when the two-sided mode is selected.

A toner collection display 122 is lit when the collecting vessel is filled with the used toner. The copy key cannot be accepted while the toner collection display 122 is lit.

A toner supplement display 123 is lit when the toner needs to be filled. The copy key cannot be accepted while the toner supplement display 122 is lit.

An original left display 124 is lit when an original is left on the original plate glass for longer than a predetermined period of time after completion of the copying operation.

A paper feed check display 125 is lit when a paper jam occurs.

In FIG. 2-b, a simulation monitor display 126 indicates the flow of paper in the main body. The simulation monitor display 126 is displayed in the normal condition. When the paper jam occurs, the paper jam check display is displayed.

A sorter display 127 is lit when the sorting mode is selected or in the sorting state.

A serial page copy display 128 is lit when the serial page copy mode is selected.

A magnification display 129 indicates the magnification set as a unit of %.

An automatic magnification display 130 is lit when the automatic magnification copy mode is selected.

A direct copy display 131 is lit when the direct copy mode is selected.

A standard size reduction display 132 is lit when the reduction copy mode of the standard size is selected.

A standard size enlargement display 133 is lit when the enlargement copy mode of the standard size is selected.

An automatic paper selection display 134 is lit when the automatic paper selection mode is selected.

An original direction display 135 indicates the set direction of an original (longitudinal or lateral direction) in accordance with the paper selected and with the copy magnification.

A paper supplement display 136 is lit when no paper exists in the selected cassette or deck, when the selected cassette is not set in the main body, or when the paper cover of the deck is open.

A use cassette display 137 indicates the selected one of the upper, middle and lower cassettes and the deck.

An * (asterisk) mode display 138 is lit when the * (asterisk) mode is set.

A copy quantity display 139 indicates the copy quantity, the coordinates upon trimming, or the self-diagnostic code.

A wait display 140 is lit while the main body is warming up. The copying operation cannot be performed while the wait display 140 is lit.

An AE display 141 is lit when the AE (automatic density control) mode is selected.

A preheating display 142 is lit when the apparatus is preheating, while it blinks when the apparatus is in the automatic shut-off state.

In the normal mode state, when the RDF is used, the apparatus is set to the one-copy mode, density AE mode, automatic paper selection mode, direct copy mode, and one-sided copy mode for copying a one-sided original. When the RDF is not used, the apparatus is set to the one-copy mode, density manual setting mode, direct copy mode, and one-sided copy mode for copying a one-sided original.

Whether the RDF is used or not is determined by checking to see if an original is set in the RDF or not.

The control of the operation of the apparatus in FIG. 1 of the present invention will then be described.

Figure 3:
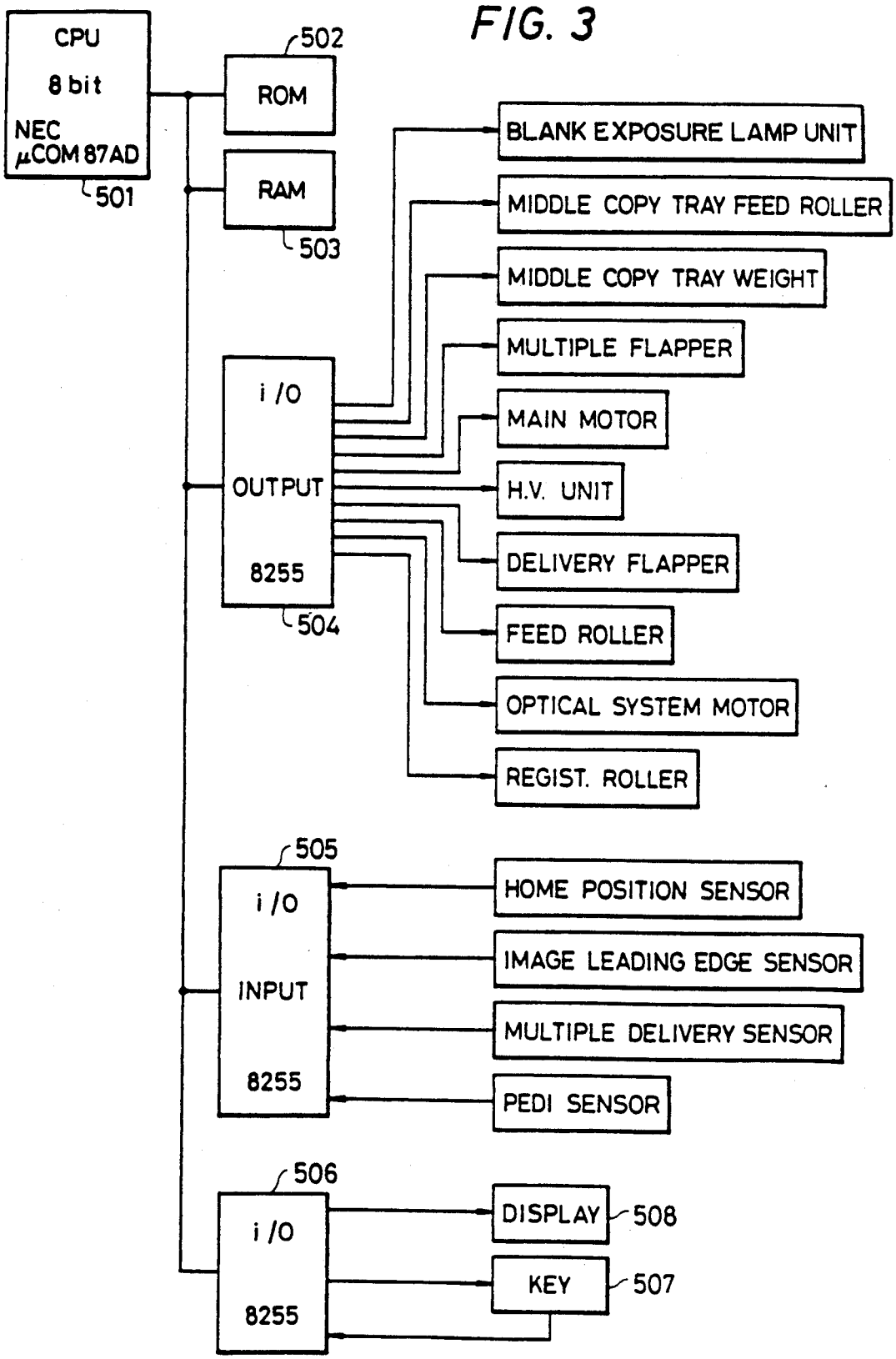
FIG. 3 is a control block diagram of the apparatus in FIG. 1.

FIG. 3 is a block diagram of a circuit to execute the present invention. For example, a μCOM 87 AD made by Nippon Electric Co., Ltd. is used as a central processing unit (CPU) 501. A control program is stored in a ROM (Read Only Memory) 502. The CPU 501 controls the apparatus in accordance with this program. A RAM (Random Access Memory) 503 serves as a main memory device. An interface 504 outputs control signals to various loads such as a main motor and the like. An interface 505 receives input signals from an image leading edge sensor and the like. An interface 506 controls the input and output of signals of a key 507 and a display in 508. The display 508 represents each display in FIG. 2 and uses an LED or an LCD. The key 507 indicates each key in FIG. 2 and it is possible to know which key was pressed due to a well-known key matrix.

FIGS. 4-1 and 4-2 are sequence control flowcharts for the CPU in FIG. 3. Particularly, the multiple copy in the serial page copy mode will then be described with reference to those flowcharts.

Figure 5:
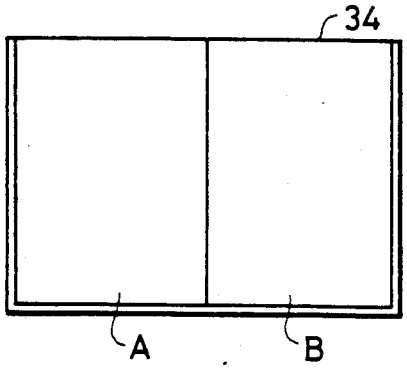
FIG. 5 is a diagram showing the set state of an original.

To perform multiple copying in the serial page copy mode, two originals A and B (each of which is the A4 size in this embodiment) are set on the original plate glass 34 as shown in FIG. 5.

Then, the serial page copy key 103 is pressed and the multiple copy mode is set by the * (asterisk) mode setting key 113. In the setting of this mode, the keys are pressed in the order of * 1 * and the CPU discriminates the depression of those keys and latches the mode corresponding to those keys into the RAM.

Practically speaking, a check is made to see if the serial page copy key 103 was pressed or not (step T1). If it was pressed, the serial page copy display 128 is lit and a check is then made to see if the multiple copy mode was set or not (step T2). If the multiple copy mode was set (namely, if the keys * 1 * were pressed), the apparatus waits until the copy start button 117 is pressed (step T3). When the copy start key 117 is pressed, the multiple flapper 52 is turned on, in other words, the flapper 52 is lifted up as indicated by the broken lines such that the transfer paper flows to a conveying path 57-2. The main motor 3 is turned on, the high voltage unit 2 is turned on, the delivery flapper 33 is turned on, namely, the flapper 33 is lifted up as shown by the broken lines, thereby allowing the transfer paper to flow to the middle copy tray (steps S2 to S5). The drum 1 is rotated once and the preprocess such as preexposure or the like is performed. After completion of the preprocess, the feed roller of the cassette selected is turned on (steps S6 and S7). Thus, the feed roller is rotated and the transfer paper is fed to the registration roller 15. At this time, a clock pulse is counted by a counter (not shown) and when the number of clock pulses becomes a count value (55 in this embodiment) corresponding to the period of time necessary for the transfer paper to be fed to the registration position, the feed roller is turned off (steps S8 and S9). During this period of time, the transfer paper reaches the registration position. The optical system is advanced by turning on an optical system motor (not shown) synchronously with the turn-off of the feed roller (step S10). When the optical system moves to the position of an image leading edge sensor 21 and the sensor 21 is turned on, the apparatus waits for the registration timing by means of a timer in a manner such that the leading edge of the image which is formed on the drum 1 and the edge of the transfer paper coincide. After an expiration of a predetermined period of time, registration roller 15 is turned on, thereby causing the transfer paper to come into contact with the drum 1 (steps S11 to S13). When the optical system further advances and the clock pulses (encoder pulses of the optical system motor) corresponding to the length in the lateral direction of the A4 size are counted, the optical system is moved backward (steps S14 and S15). When a home position sensor 22 is turned on due to the backward movement of the optical system, the optical system motor is turned off to stop the optical system (steps S15-1 and S15-2). Thereafter, the image of the original A is copied and the transfer paper passes through the conveying paths 57 and 57-2 by way of the delivery flapper 33 and multiple flapper 52 and is loaded on the middle copy tray 59. When a multiple delivery sensor 24 is turned on and is then turned off within a predetermined period of time (corresponding to the time interval when the front and rear edges of the paper pass through the sensor 24) and it is confirmed that the transfer paper was loaded in the middle tray 59, the delivery flapper 33 is turned off, namely, the flapper 33 is put down as shown by the solid lines and the multiple flapper 52 is turned off, namely, the flapper 52 is put down as indicated by the solid lines (steps S16 to S19). The middle copy tray weight 53 is put on the transfer paper loaded in the middle tray 59 (step S20). The middle copy tray feed roller 51 is turned on to lead the transfer papers one by one from the bottom to the conveying path 58 (step S21). The transfer paper is allowed to wait at the position of the registration roller 15. The optical system is again advanced (step S22) and when the image leading edge sensor 21 is turned on, the clock pulses corresponding to the length in the lateral direction of the A4 size are counted. After completion of this counting of the A4 size, a predetermined period of time (150 m.sec in this embodiment) is timed by a timer (not shown), thereby matching the registration timing (steps S23 to S25). The registration roller 15 is then turned on and the image of the original B is overlapped and copied on the transfer paper on which the image of the original A has already been copied. When the optical system further advances and an inversion sensor 25 is turned on, the optical system is moved backward (steps 27 and S28) and is returned to the home position. When the home position sensor 22 is turned on, the high voltage unit 2 is turned off and the main motor 3 is then turned off after the expiration of a predetermined period of time. However, this control procedure is not applied to the serial page copy mode. The transfer paper on which the images of the originals A and B were copied is delivered to the outside (the sorter 400) due to the action of the delivery flapper 33. In case of copying a plurality of papers, a desired copy quantity may be set by the ten-key set 112. Pressing the copy start button 117 allows the cycle of scanning the original A and copying the image thereof to be executed a set number of times, and a set number of copy papers of the original A are loaded in the middle tray 59. Next, the transfer papers loaded in the middle tray 59 are fed one by one from the bottom and the original B is scanned and the image of the original B is copied on the transfer paper. This operation is repeated only a set number of times.

The other copy modes will then be briefly explained. In step T2, if the multiple copy mode is not set, a check is made to see if the two-sided copy key 101 was pressed or not (step T4). If it was pressed, the apparatus waits until the copy start button 117 is pressed (step T5). When the copy button is turned on, the process for the two-sided copy in the serial page copy mode is performed (step T6). Namely, the original A is first scanned and the image of the original A is copied on the surface of the transfer paper. Then, the delivery flapper 33 is turned on (in the lift-up state) and the multiple flapper 52 is turned off (in the put-down state) and the copied transfer paper is inverted upside down through a conveying path 57-1 and loaded in the middle tray 59. Then, the original B is scanned and the image of the original B is copied on the back surface of the transfer paper. The delivery flapper 33 is turned off and the transfer paper in which the images of the originals A and B were copied on both front and back surfaces is delivered to the outside of the apparatus.

On the other hand, when the copy button 117 is turned on in the state in which the two-sided copy key 101 is not pressed in step T4, the process for the one-sided copy in the serial page copy mode is carried out (steps T7 and T8). Namely, the original A is first scanned and the image of the original A is copied on the transfer paper. The delivery flapper 33 is turned off to deliver the transfer paper copied to the outside of the apparatus. Then, the original B is scanned and copied and the copied transfer paper is delivered to the outside of the apparatus in a similar manner as above.

When the serial page copy key 103 is not turned on in step T1, a check is made to see if the multiple copy mode was set or not (step T9). If it was set, the apparatus waits until the copy button 117 is pressed (step T10). If the copy button was pressed, the process for the multiple copy is performed (step T11). That is, an original is set on the original plate or RDF 300 and copied on the transfer paper. The delivery flapper 33 and multiple flapper 52 are turned on and the transfer paper is allowed to pass through the conveying paths 57 and 57-1 and is loaded in the middle tray 59. Next, another original is set and the image of this original is overlappingly copied on the transfer paper on which the image of the original A has already been copied. The delivery flapper 33 is turned off to deliver the copied transfer paper to the outside of the apparatus.

If the multiple copy mode is not set in step T9, a check is made to see if the two-sided copy key 101 was turned on or not (step T12). When it was pressed, the apparatus waits until the copy button 117 is turned on (step T13). When the copy button was pressed, the process for the two-sided copy is executed (step T14). In this case, there are three kinds of modes: the two-sided copy mode for copying a two-sided original; the one-sided copy mode for copying a two-sided original; and the two-sided copy mode for copying a one-sided original. In the two-sided copy mode for copying a two-sided original, the two-sided original is set in the RDF 300 to perform the copying of the front surface of the original. The copied transfer paper is loaded in the middle tray 59 through the conveying paths 57 and 57-1 by the multiple flapper 52. The original is then inverted upside down by the RDF 300 and the original image of the back surface is copied on the back surface of the transfer paper in which the image has already been copied on the front surface and delivered to the outside of the apparatus by the delivery flapper 33. In the case of performing one-sided copying from a two-sided original, on one hand, the two-sided original is set in the RDF and the surface image of this original is copied and then the copied transfer paper is delivered to the outside of the apparatus. Then, the original is inverted upside down by the RDF 300 and the back surface image is copied and the transfer paper is then delivered to the outside of the apparatus. On the other hand, in case of performing two-sided copying from a one-sided original, the original is set on the original plate or RDF an copied on the front surface of the transfer paper. This transfer paper is sent through the conveying paths 57 and 57-1 by the delivery flapper 33 and multiple flapper 52 and is loaded in the middle tray 59. Then, the next original is set and the image of this original is copied on the back surface of the transfer paper in which the original image has already been copied on the front surface. Thereafter, the transfer paper is delivered to the outside of the apparatus. Pressing the two-sided key 101 once allows the apparatus to enter the two-sided copy mode copying a one-sided original. Pressing the key 101 again permits the apparatus to enter the two-sided copy mode copying a two-sided original. Pressing the key 101 again allows the apparatus to enter the one-sided copy mode copying a two-sided original. Pressing the key 101 again permits the apparatus to enter the normal copy mode (one-sided copy mode copying a one-sided original). In this manner, the copy mode is circulated every time the key 101 is pressed.

On the other hand, if the two-sided key 101 is not turned on in the step T12, the apparatus waits until the copy start button 117 is turned on (step T15). When it is pressed, the normal copy process is executed (step T16).

Although a description has been provided with respect to the original of A4 size in the above embodiment, the invention can be apparently also applied to originals of B5 size or other sizes. In addition, originals of A3 and B4 sizes or right and left images of the originals of a book can also be synthesized.

On the other hand, with respect to the operation of the optical system, there is no need to return the optical system to the home position after the original A was scanned, but the optical system may be allowed to wait at the scan start position of the original B. Also, the original B may be first scanned and then the original A may be scanned.

As described above, for instance, if multiple copying is performed assuming that the original A is a document and the original B is a paper filled with necessary data, the documents can be easily made. In addition, the document such as a certificate of the registered seal or the like can be also made.

On one hand, in case of copying originals of a book in the serial page copy mode, the binding portion of the right and left pages cannot completely come into contact with the original plate, so that black portions are caused on the copied paper. Therefore, if original pages are copied while performing the trimming for every page, the above-mentioned problem can be solved. The control for this purpose will then be described hereinbelow.

Figure 7A:
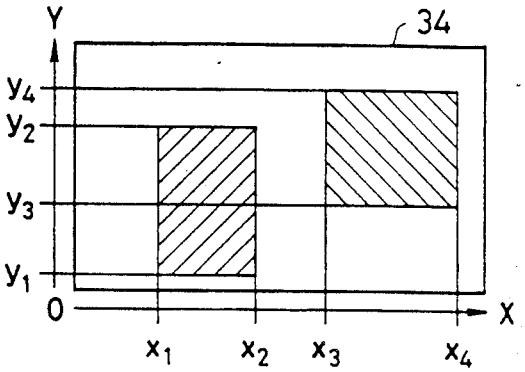
FIG. 7A is a diagram showing the coordinates on the original plate.
Figure 6:
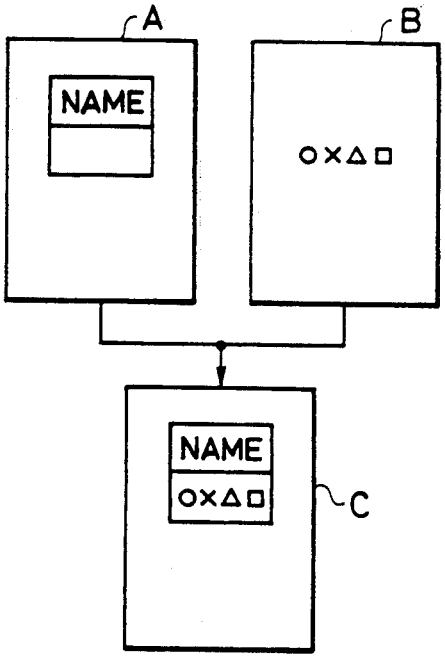
FIG. 6 is a diagram showing an output example according to the present invention.
Figure 7B:
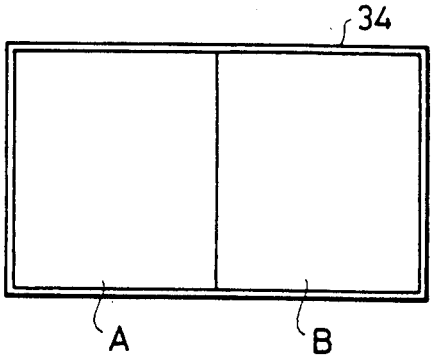
FIG. 7B is a diagram showing the set state of the original.

To perform multiple copying in the serial page copy mode by use of the trimming function, as shown in FIG. 7-B, two originals A and B (each of which is the A4size in this embodiment) are set on the original plate glass 34. Then, the serial page copy key 103 is pressed and the multiple copy mode is set by the * (asterisk) mode setting key 113. In setting of this mode, the keys * 1 * are pressed in these order, so that the CPU 501 discriminates this depression and latches the mode corresponding to those keys into the RAM 503. Similarly, the trimming mode is set by pressing the * 2 * keys. When the trimming mode is set, the apparatus enters the state in which the trimming regions are inputted. The trimming regions correspond to the hatched portions surrounded by the coordinates ($x_1$, $x_2$, $y_1$, $y_2$) and ($x_3$, $x_4$, $y_3$, $y_4$) shown in FIG. 7-A.

When the trimming mode is set, the apparatus then waits for the inputting of the coordinate $x_1$. By setting the distance from the origin using the ten-key set 112 and pressing the * key, the position of the coordinate $x_1$ is latched into the RAM 503. The apparatus then waits until the coordinate $x_2$ is input. In a similar manner as above, the positions of the coordinates $x_2$, $y_1$, $y_2$, $x_3$, $x_4$, $y_3$, and $y_4$ are set and the trimming regions are completely defined. In the case where the serial page copy mode is set, after the trimming regions of the original A were set, the trimming regions of the original B are set. The setting of the mode and coordinates is not limited to the above method but may be realized by other methods.

If a scale is attached to the sides of the original plate glass 34 the coordinates can be easily set.

Figures 1, 8:
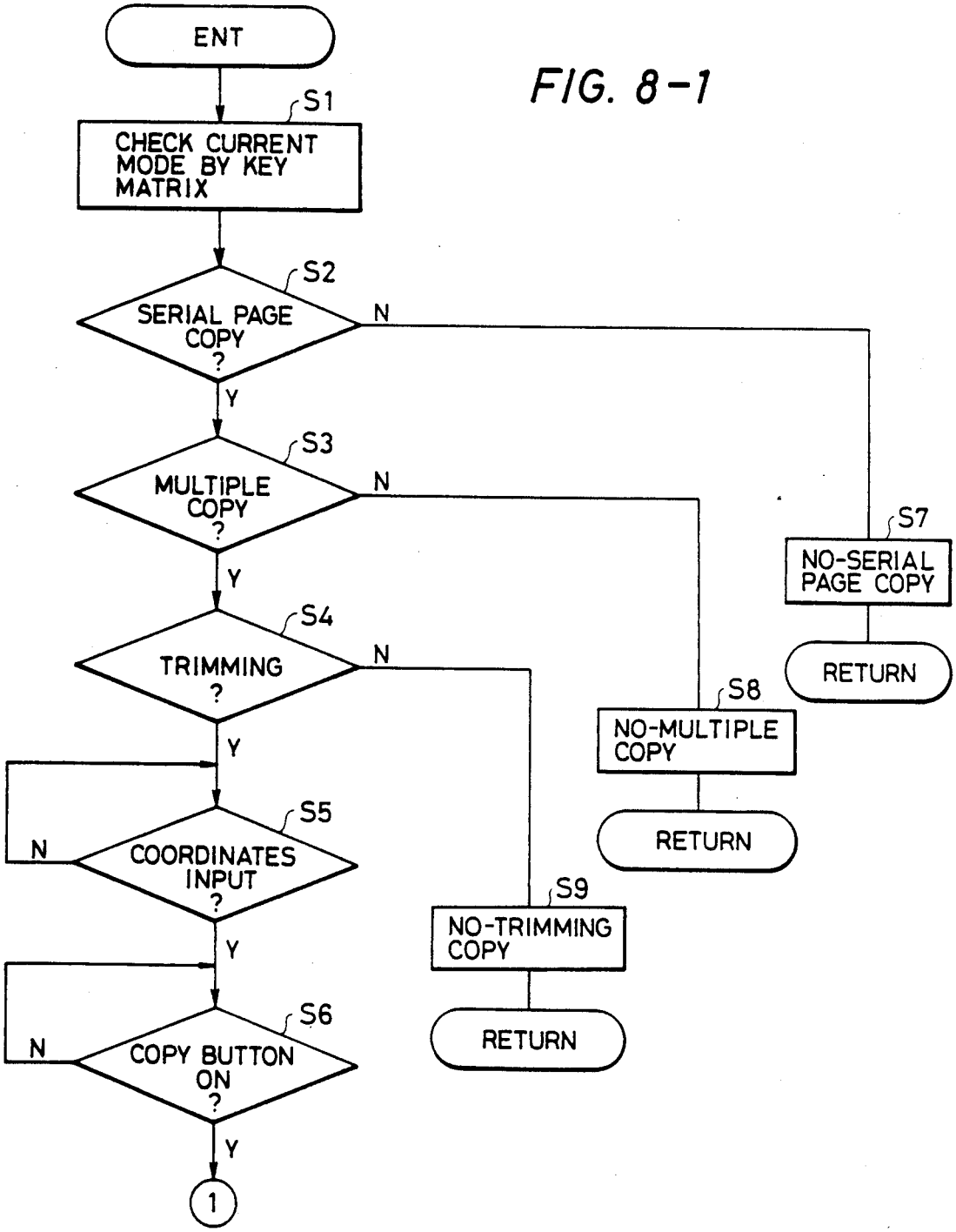
Figures 2, 8:
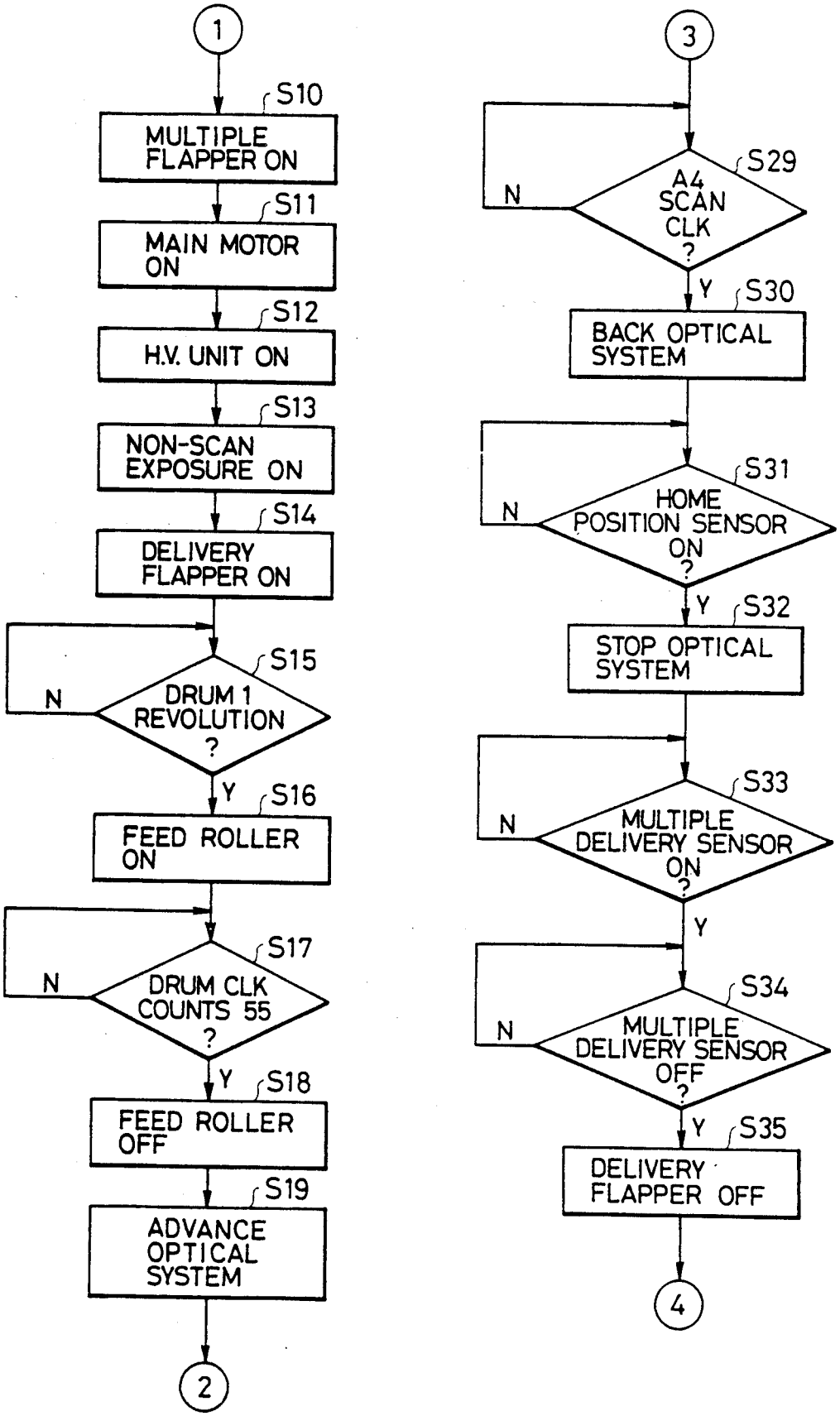
Figures 3, 8:
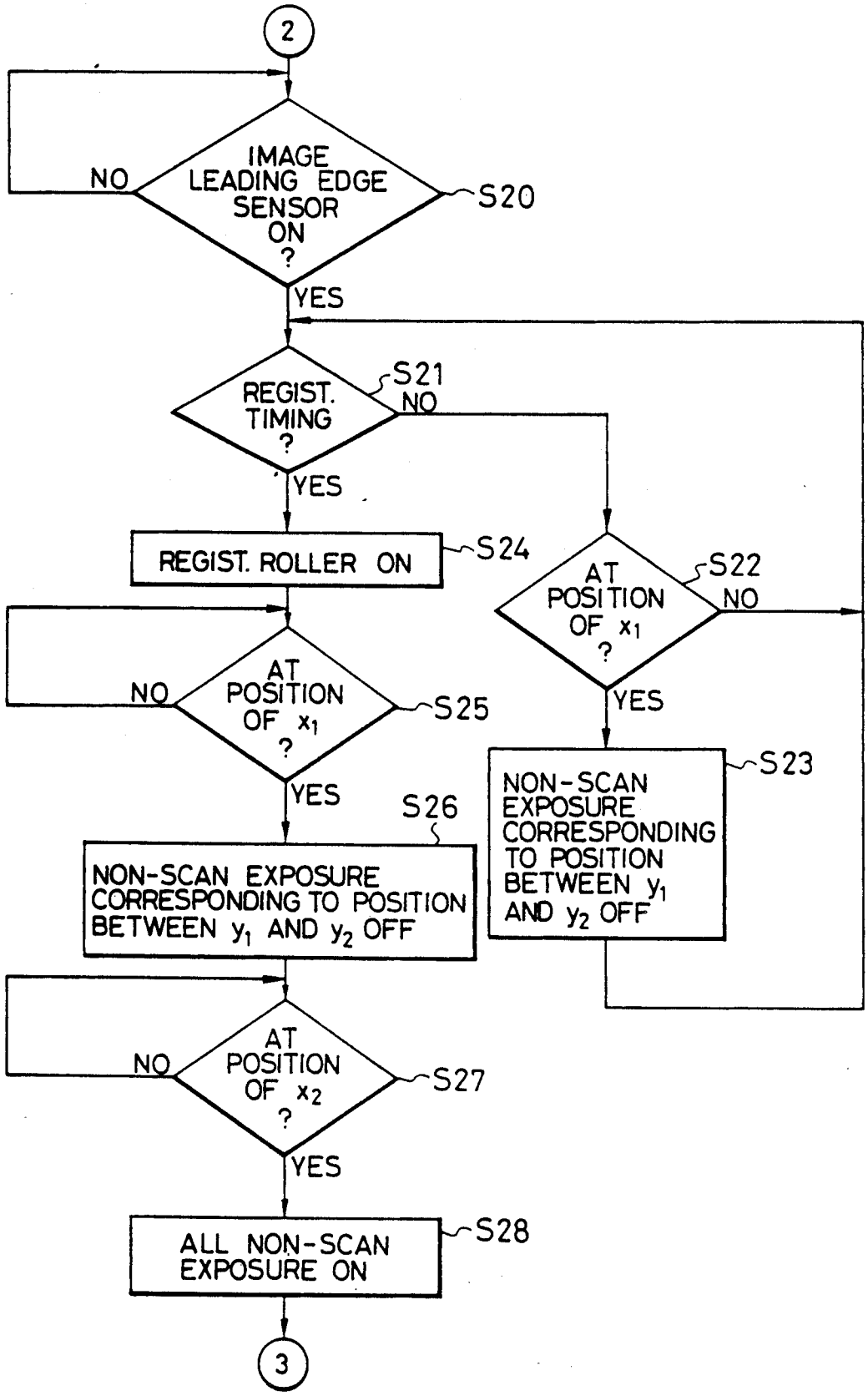
Figures 4, 8:
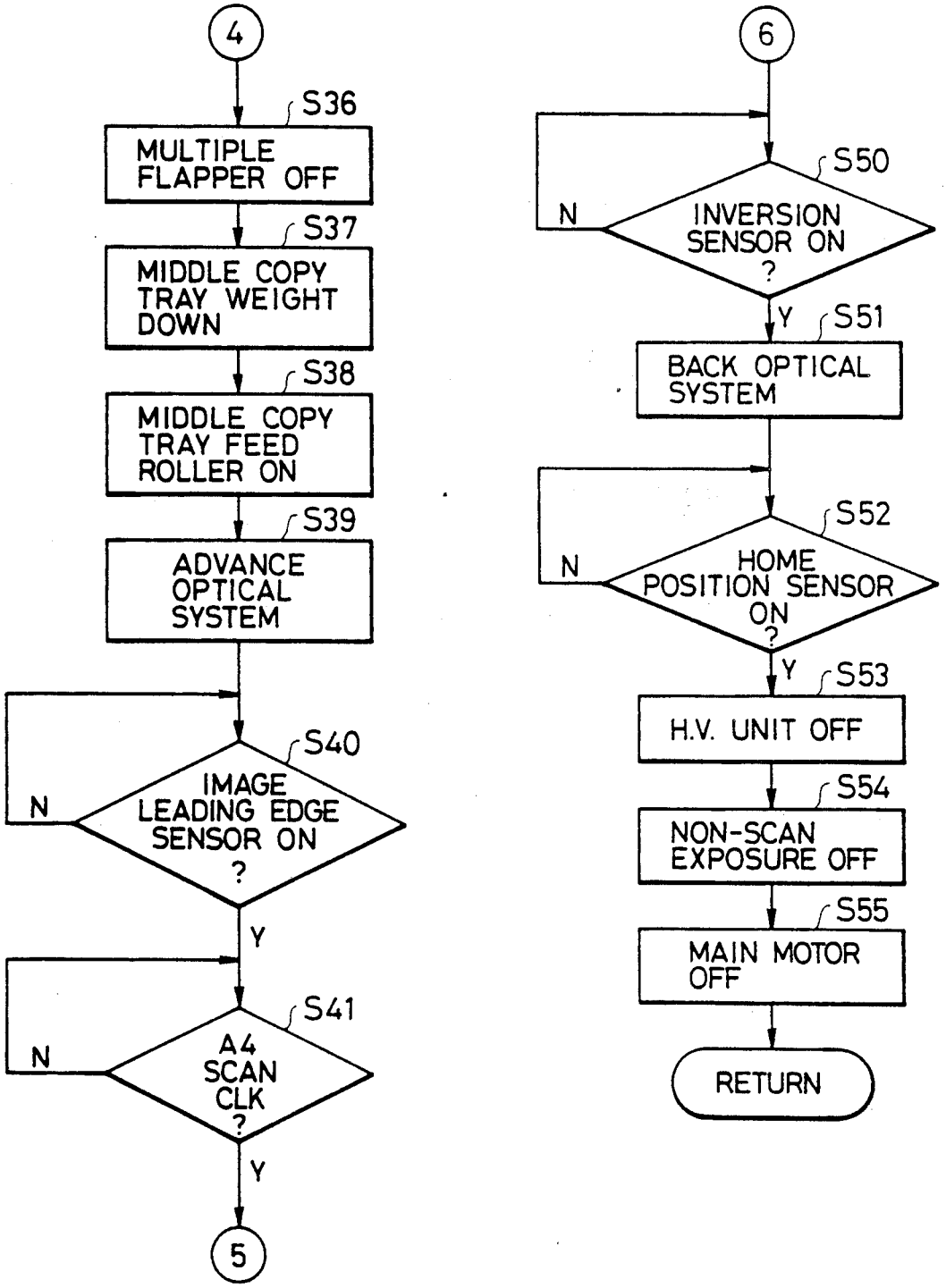
Figures 5, 8:
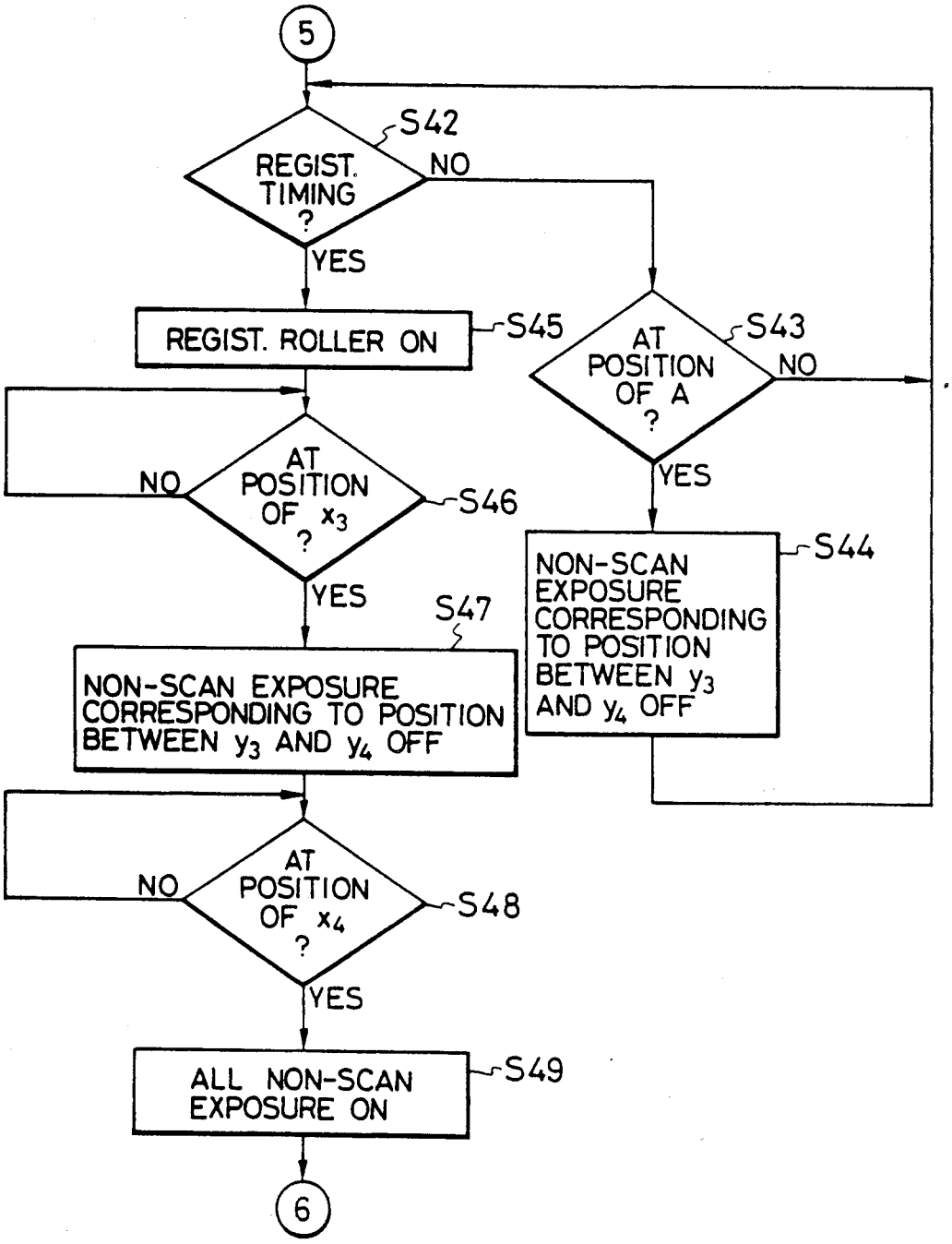

In FIGS. 8-1 to 8-4, a check is made to see which key is pressed at present by use of a well-known key matrix in step S1. A check is made to see if the serial page copy key 103 was pressed or not (step S2). When the key 103 was pressed, the serial page copy display 128 is lit and a check is made to see if the apparatus is in the multiple copy mode or not (step S3). If the multiple copy mode was set (namely, the * 1 * keys were pressed), a check is made to see if the trimming mode was set or not (step S4). When the trimming mode was set (namely, the * 2 * keys were pressed), the apparatus waits until the coordinates for trimming are input (step S5). After the coordinates were input, the apparatus waits for the depression of the copy button 117 (step S6). If the serial page copy key is not pressed in step S2, the copy process in other copy mode than the serial page copy mode is executed (step S7). Unless the multiple copy mode is set in step S3, the copy process in other copy mode than the multiple copy mode is executed (step S8). Unless the trimming mode is set in step S4, the copy process in other copy mode than the trimming mode is executed (step S9). When the copy key 117 is turned on in step S6, the multiple flapper 52 is turned on, that is, the flapper 52 is lifted up, thereby allowing the transfer paper to flow to the conveying path 57-2. The main motor 3 is turned on, the high voltage unit 2 is turned on, the non-scan exposure lamp 60 is turned on, and the delivery flapper 33 is turned on, namely, the flapper 33 is lifted up, thereby permitting the transfer paper to flow to the middle copy tray 59 (steps S10 to S14). The drum 1 is rotated once to perform the preprocess. Upon completion of the preprocess, the feed roller of the cassette selected is turned on (steps S15 and S16).

Thus, the feed roller rotates and the transfer paper is fed to the registration roller 15. At this time, a clock pulse is counted by the counter (not shown). When the counter indicates a count value (55 in this embodiment) corresponding to the period of time when the transfer paper is fed to the registration position, the feed roller is turned off (steps S17 and S18). During this period of time, the transfer paper reaches the registration position. The optical system is advanced by turning on the optical system motor (not shown) synchronously with the turn-off of the roller (step S19). When the optical system moves to the position of the image leading edge sensor 21 and the sensor 21 is turned on, the apparatus waits for the registration timing by means of a timer such that the leading edge of the image formed on the drum 1 coincides with the front edge of the transfer paper. Before the registration timing, a check is made to see if the optical system was moved to the position of the coordinate $x_1$ of the original A or not and if it moved to the $x_1$ position, the non-scan exposure lamp 60 corresponding to the position between the coordinates $y_1$ and $y_2$ of the original A on the photo sensitive material 1 is turned off (steps S20 to S23). The position of the optical system is decided by counting the clock pulses corresponding to the traveling distance to the position of the coordinate $x_1$. The encoder pulse of the optical system motor is used as such a clock.

At the registration timing, the registration roller 15 is turned on for allowing the transfer paper to be come into contact with the drum 1 (step S24). Next, a check is made to see if the optical system is moved to the position of the coordinate $x_1$ of the original A or not (step S25). If it moved to the $x_1$ position, the non-scan exposure lamp corresponding to the position between the coordinates $y_1$ and $y_2$ of the original A on the drum 1 is turned off (step S26).

A check is then made to see if the optical system is moved to the position of the coordinate $x_2$ of the original A or not (step S27). If it moved to the $x_2$ position, all of the non-scan exposure lamps 60 are turned on (step S28). When the optical system further advances and the clock pulses (encoder pulses of the optical system motor) corresponding to the length in the lateral direction of the A4 size are counted, the optical system is moved backward (steps S29, S30). When the home position sensor 22 is turned on due to the backward movement of the optical system, the optical system motor is turned off to stop the optical system (steps S31, S32). Thereafter, the image of the original A is copied and the transfer paper is allowed to pass through the conveying paths 57 and 57-2 by the delivery flapper 33 and multiple flapper 52 and is loaded in the middle copy tray 59. When the multiple delivery sensor 24 is turned on and is then turned off within a predetermined period of time and it is confirmed that the transfer paper was loaded in the middle tray 59, the delivery flapper 33 is turned off, namely, the flapper 33 is lifted up and the multiple flapper 52 is turned off, that is, the flapper 52 is put down (steps S33 to S36). The middle copy tray weight 53 is put on the transfer paper loaded in the middle tray 59 (step S37). The middle copy tray feed roller is turned on to lead the transfer papers one by one from the bottom to the conveying path 58 (step S38). The transfer paper is allowed to wait at the position of the registration roller 15. The optical system is again advanced (step S39) and when the image leading edge sensor 21 is turned on, the clock pulses corresponding to the length in the lateral direction of the A4 size are counted. After the clock pulses as much as the A4 size were counted, a predetermined period of time (150 msec in this embodiment) is timed by the timer (not shown), thereby matching the registration timing (steps S40 to S42). A check is made to see if the optical system is moved to the position of the coordinate $x_3$ of the original B or not until the registration timing (step S43). If the optical system moved to the $x_3$ position, the non-scan exposure lamp corresponding to the position between the coordinates $y_3$ and $y_4$ of the original B on the drum 1 is turned off (step S44).

At the registration timing, the registration roller 15 is turned on for allowing the transfer paper to come into contact with the drum 1 (step S45). Next, a check is made to see if the optical system moved to the position of the coordinate $x_4$ of the original B or not. If it moved to the $x_4$ position, the non-scan exposure lamp corresponding to the position between the coordinates $y_3$ and $y_4$ of the original B on the drum 1 is turned off (step S47).

Subsequently, a check is made to see if the optical system moved to the position of the coordinate $x_4$ of the original B or not (step S48). If it moved to the $x_4$ position, all of the non-scan exposure lamps 60 are turned on (step S49). The image of the original B is overlappingly copied on the transfer paper on which the image of the original A has already been copied. When the optical system further advances and the inversion sensor 25 is turned on, the optical system is moved backward (steps S50, S51) and is returned to the home position. When the home position sensor 22 is turned on, the high voltage unit 2 is turned off, the non-scan exposure lamp 60 is turned off, and the main motor 3 is turned off (steps S52 to S55). The transfer paper on which the images of the originals A and B were copied is delivered to the outside (sorter 400) of the apparatus due to the action of the delivery flapper 33.

Figure 10A:
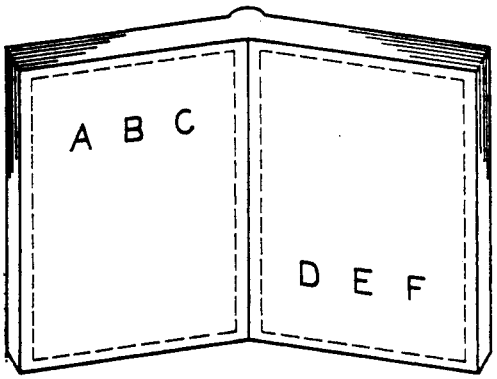
FIGS. 9, 10A to 10C, 12, 14 and 16 are diagrams showing output examples of other embodiments according to the present invention.
Figure 10B:
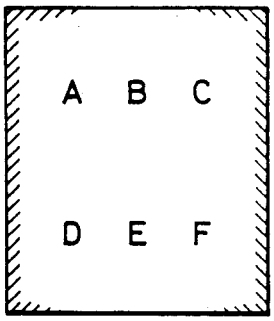
Figure 9:
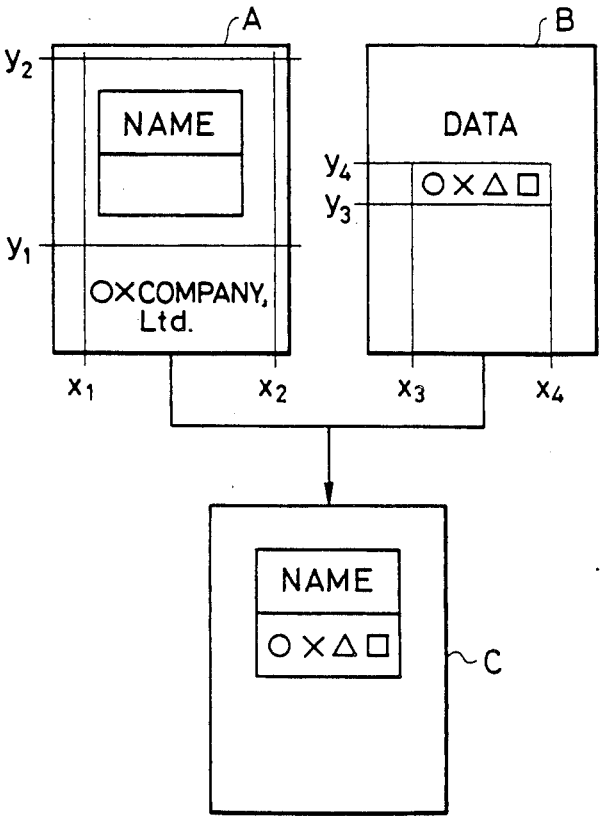
Figure 10C:
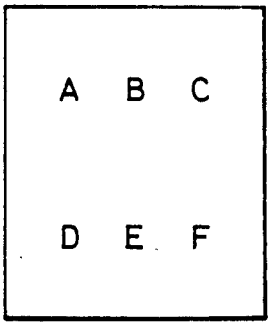

In this manner, as shown in FIG. 9, the necessary portions of two images are trimmed and can be synthesized. In addition, as shown in FIG. 10-A, even in case of multiple copying book originals, by designating the trimming mode, the shaded portions as shown in FIG. 10-B can be erased, so that the book originals can be cleanly copied as shown in FIG. 10-C.

The case where multiple copying is performed in the serial page copy mode using the image shifting function will now be described. First, as shown in FIG. 5, two originals A and B (each of which is the A4 size in this embodiment) are set on the original plate glass 34.

The serial page copy key 103 is pressed and the * (asteriak) mode setting key 113 is pressed to set the multiple copy mode. In setting of this mode, by pressing the * 1 * keys, the CPU 501 descriminates this depression and latches the mode corresponding to those keys into the RAM 503. Likewise, the image shift mode is set by pressing the * 3 * keys. When the image shift mode is set, the apparatus then enters the state in which the image shift amount of the original A shown in FIG. 5 is input. This mode is set as follows. The direction for the image shift is input by the "+" and "−" keys of the zoom key 104 (see FIG. 2-a), while the image shift amount is input by the ten-key set 112. By subsequently pressing the * key, the image shift amount of the original A is latched into the RAM 503. Then, the apparatus enters the state in that the image shift amount of the original B is input. A method of setting the image shift with regard to the original B is substantially similar to that for the original A. Namely, by pressing the * key, each data is latched into the RAM 503. In this way, the data input of the image shift is completed.

Figures 1, 11:
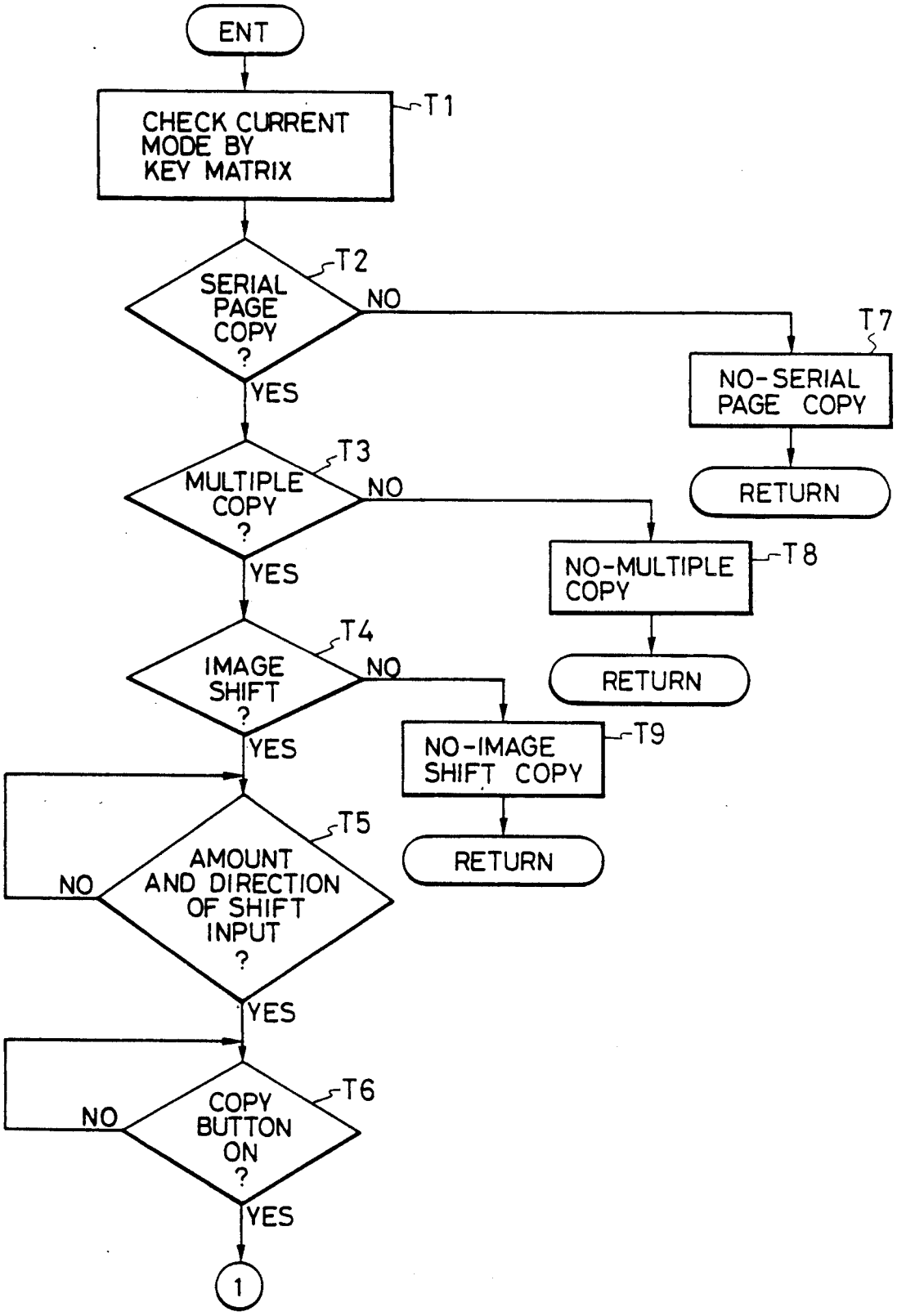
Figures 2, 11:
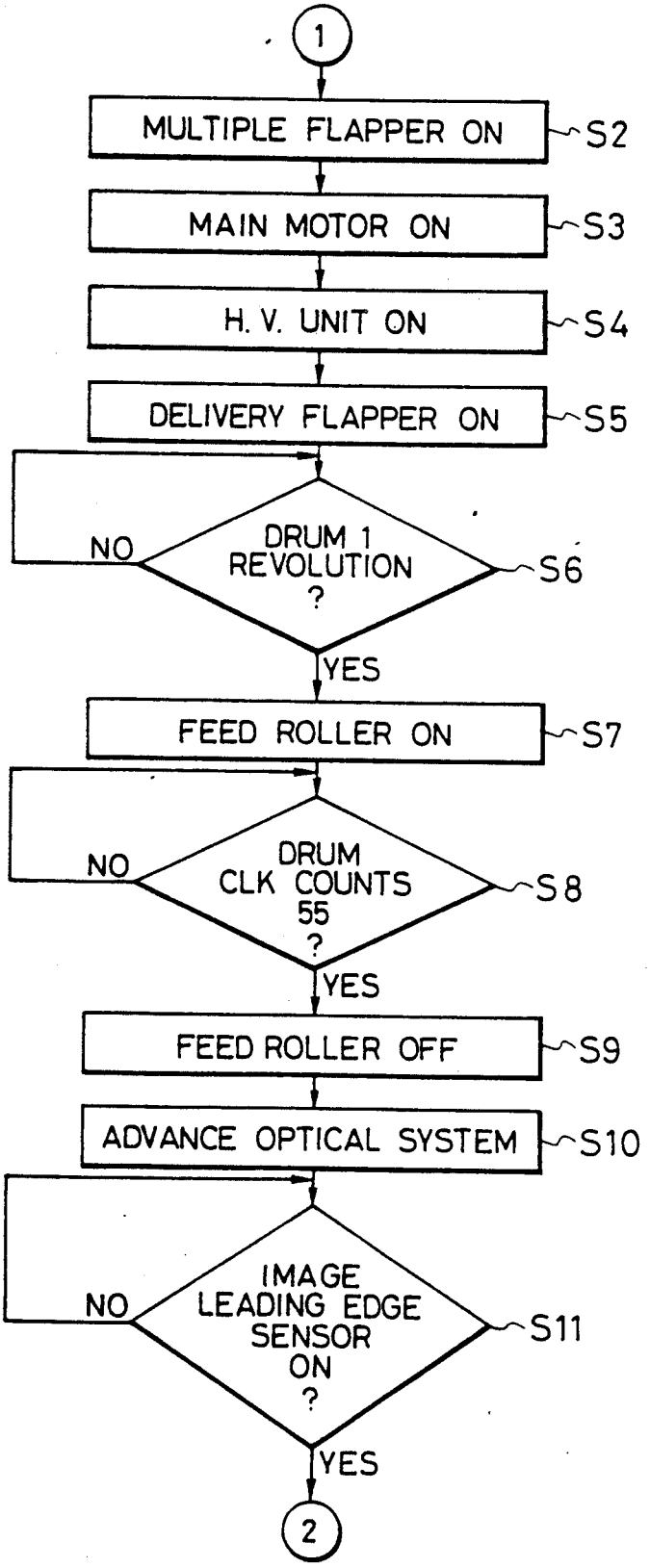
Figures 3, 11:
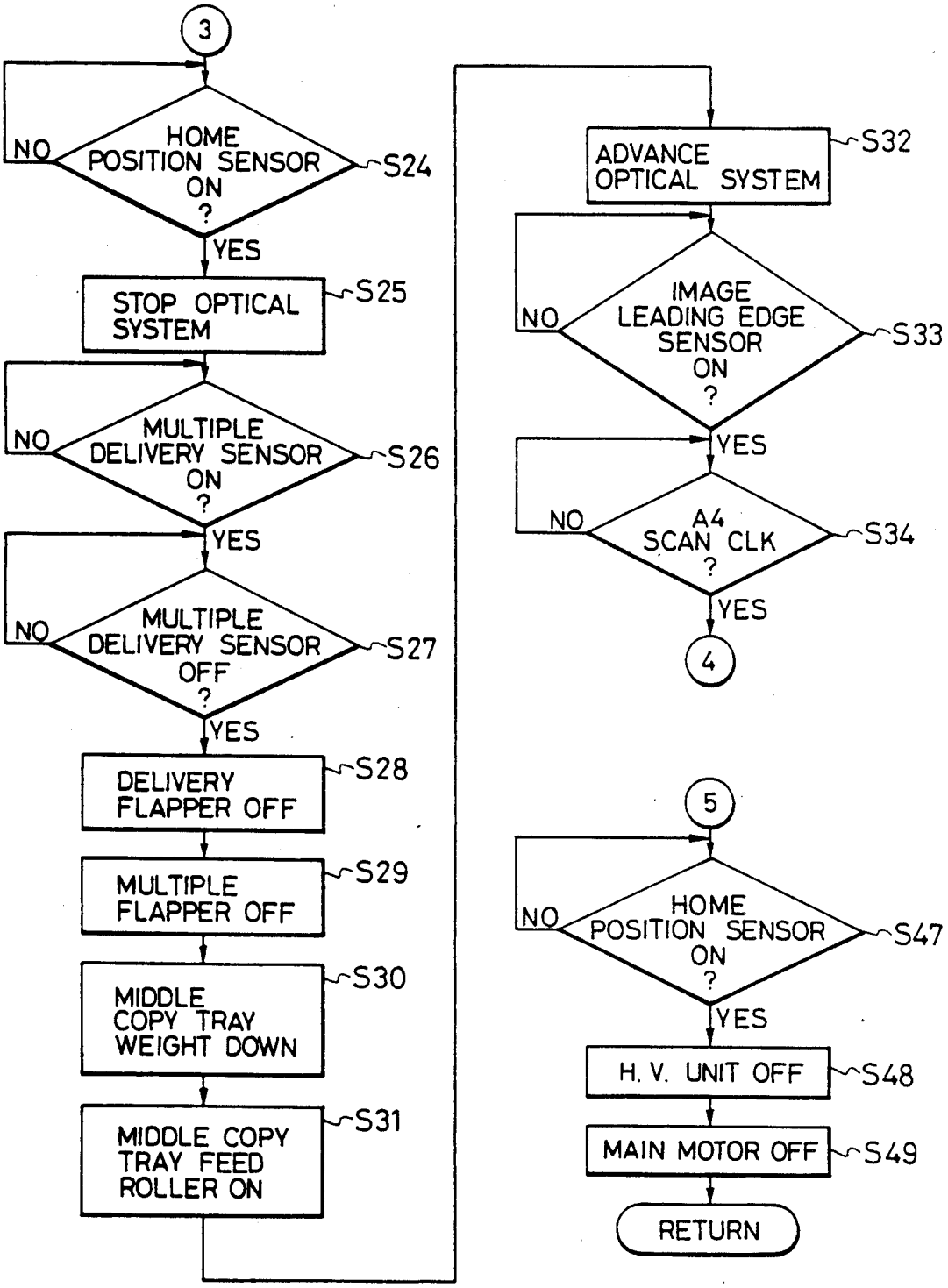
Figures 4, 11:
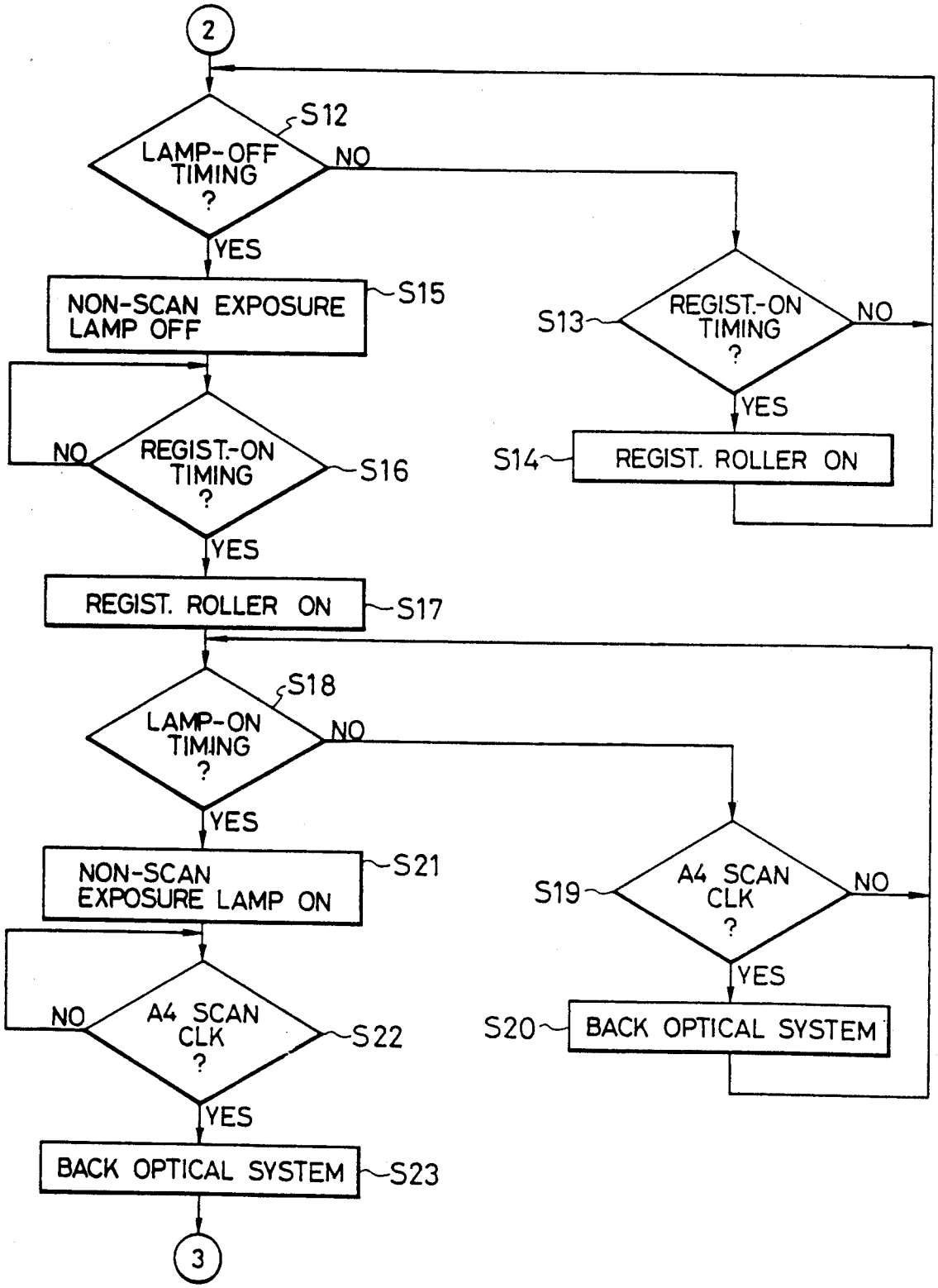
Figures 5, 11:
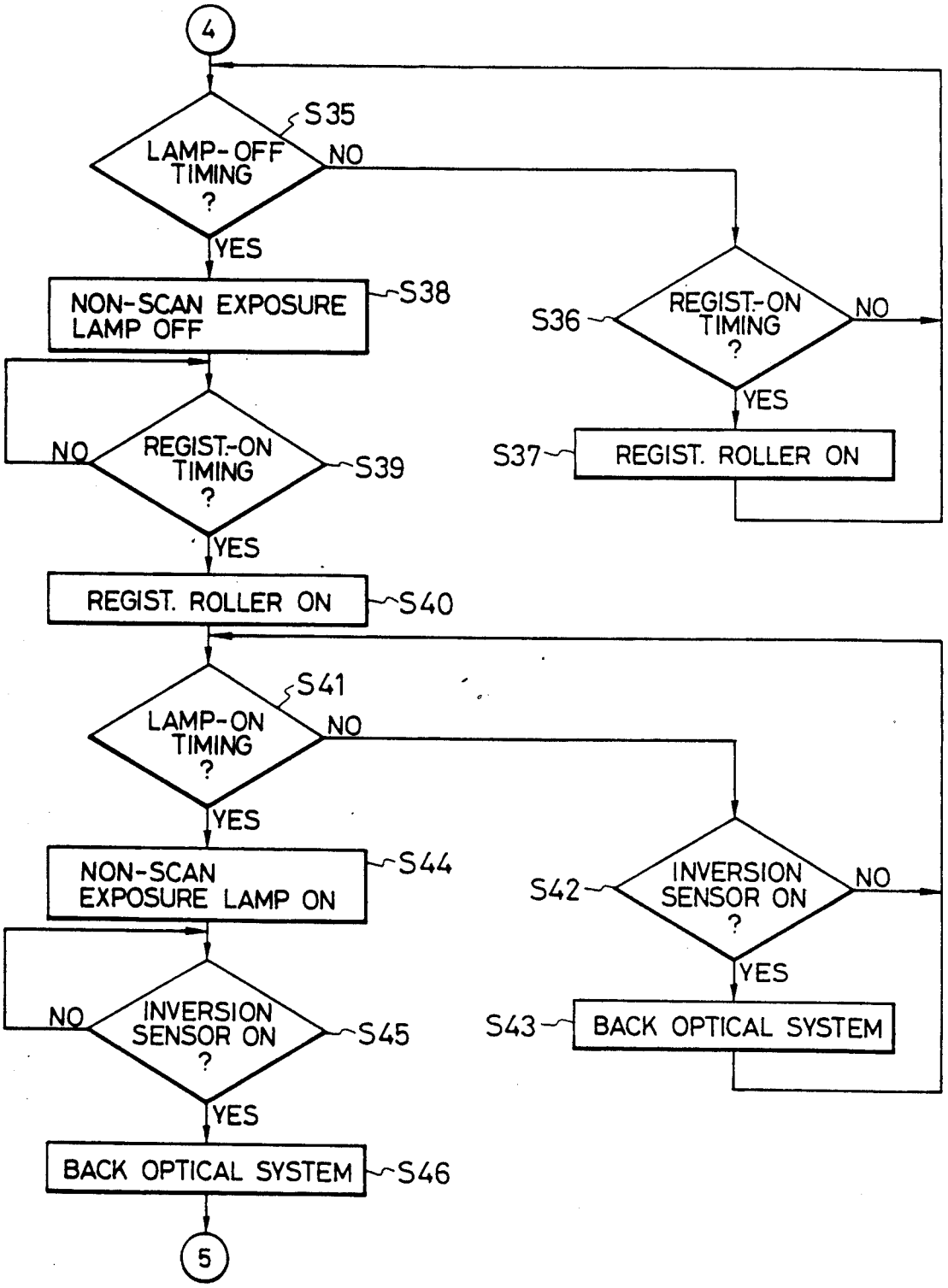

Referring now to FIGS. 11-1 to 11-4, a check is first made to see which key is pressed at present by way of a well-known key matrix (step T1). A check is then made to see if the serial page copy key 103 was pressed or not (step T2). It it was pressed, the serial page copy display 128 is lit and a check is made to see if the multiple copy mode was set or not (step T3). If the multiple copy mode was set (namely, the * 1 * keys were pressed), a check is made to see if the image shift mode was set or not (step T4). If the image shift mode was set (that is, the * 3 * keys were pressed), the apparatus waits until the shift amount and shift direction are inputted (step T5). When they are input, the apparatus waits until the copy button 117 is pressed. Unless the serial page copy key 103 is pressed in step T2, the copy process in a copy mode other than the serial page copy mode is executed (step T7).

Unless the multiple copy mode is set in step T3, the copy process in a copy mode other than the multiple copy mode is executed (step T8). Unless the image shift mode is set in step T4, the copy process in a copy mode other than the image shift mode is executed (step T9). If the copy start key 117 was turned on, the multiple flapper 52 is turned on, namely, the flapper 52 is lifted up, thereby allowing the transfer paper to flow to the conveying path 57-2. The main motor 3 is turned on, the high voltage unit 2 is turned on, all of the non-scan exposure lamps 60 are lit, and the delivery flapper 33 is turned on, namely, the flapper 33 is lifted up, thereby allowing the transfer paper to flow to the middle copy tray side (steps S2 to S5). The drum 1 is rotated once and the preprocess is performed. After completion of the preprocess, the feed roller of the cassette selected is turned on (steps S6, S7). The feed roller rotates, so that the transfer paper is sent to the registration roller 15. At this time, clock pulses are counted by the counter (not shown) and when the counter indicates the count value (55 in this embodiment) corresponding to the period of time when the transfer paper is fed to the registration position, the feed roller is turned off (steps S8, S9). The optical system is advanced by turning on the optical system motor (not shown) synchronously with the turn-off of the feed roller (step S10). When the optical system moves to the position of the image leading edge sensor 21 and the sensor 21 is turned on (step S11), a check is then made to see if it is a time to turn off the lighting non-scan exposure lamp 60 in order to prevent unnecessary toner from being deposited on the drum (step S12). If it is not the time to turn off the lamp 60, the apparatus waits for the timing at which the registration roller is turned on (step S13) and the registration roller 15 is turned on, thereby allowing the transfer paper to come into contact with the drum 1 (step S14).

On the contrary, when it is the time to turn off the lamp 60, the lamp 60 is turned off (step S15) and the apparatus waits for the timing to turn on the registration clutch (step S16) and the registration roller 15 is turned on (step S17).

The registration roller is turned on when the leading edge of the image formed on the drum 1 coincides with the front edge of the transfer paper in the case where the image shift mode is not set. On the contrary, in the case where the image shift mode is set, the registration roller is turned on when the leading edge of the image formed on the drum 1 coincides with the position of the transfer paper in consideration of the image shift amount with regard to the original A.

Next, a check is made to see if it is the time that the necessary latent image of the original A is formed on the drum and all of the non-scan exposure lamps 60 are lit (step S18). If it is not the time to light all of the lamps 60, a check is made to see if the optical system scans the region of the A4 size (by counting the encoder pulses of the optical system motor) (step S19). Upon completion of this scan, the optical system is moved backward (step S20). When, it is the time to light all of the lamps 60, these lamps are all lit (step S21) and a check is made to see if the optical system scanned the region corresponding to the A4 size of the original (step S22), thereby allowing the optical system to be moved backward (step S23).

The timings to turn on and off the lamp 60 differ in dependence on the size of the paper and on the image shift amount and are controlled so as to prevent the deposition of an unnecessary additional amount of toner on the drum surface or the formation of images other than the content of the original on the paper.

When the optical system is moved backward and the home position sensor 22 is turned on, the optical system motor is turned off to stop the optical system (steps S24, S25). Thereafter, the image of the original A is copied and the transfer paper is allowed to pass through the conveying paths 57 and 57-2 by the delivery flapper 33 and multiple flapper 52 and is loaded in the middle tray 59. When the multiple delivery sensor 24 is turned on and is then turned off within a predetermined period of time and it is confirmed that the transfer paper was loaded in the middle tray 59, the delivery flapper 33 is turned off, namely, the flapper 33 is put down and the multiple flapper 52 is turned off, that is, the flapper 52 is put down (steps S26 to S29). The middle copy tray weight 53 is put on the transfer paper loaded in the middle tray 59 (step S30) and the middle copy tray feed roller is turned on, thereby allowing the transfer papers to be led one by one from the bottom to the conveying path 58 (step S31). The transfer paper is allowed to wait at the position of the registration roller 15. The optical system is again advanced (step S32) and when the sensor 21 is turned on, the clockpulses corresponding to the length in the lateral direction of the A4 size are counted. After completion of the counting of the clockpulses as much as the A4 size, a predetermined period of time (150 msec in this embodiment) is timed by the timer (not shown). Then, the apparatus waits for the timing to turn off the lamp 60 (step S35). If it is not the time to turn off the lamp 60, a check is made to see if it is the time to turn on the registration roller 15 or not (step S36). If it is the time to turn on the registratior roller 15, it is turned on (step S37).

If it is the time to turn off the lamp 60, it is turned off (step S38) and the apparatus waits for the timing to turn on the registration roller 15 (step S39). Then, by turning on the roller 15, the transfer paper comes into contact with the drum and the image of the original B is overlappingly copied on the paper on which the image of the original A has already been copied (step S40).

After the latent image of the original B was formed on the drum surface, the apparatus waits for the timing to light the lamp 60 (step S41).

Before the non-scan exposure timing, the apparatus also waits until the inversion sensor 25 is turned on (step S42). When the inversion sensor 25 is turned on, the optical system is moved backward (step S43).

At the non-scan exposure timing, all of the lamps 60 are lit (step S44) and the apparatus waits for the turn-on of the inversion sensor (step S45). When it is turned on, the optical system is moved backward (step S46), thereby returning the optical system to the home position. When the home position sensor 22 is turned on, the high voltage unit 2 is turned off, the lamp 60 is turned off, and the main motor 3 is turned off (steps S47 to S49). The transfer paper on which the images of the originals A and B were copied is delivered to the outside (sorter 400) of the apparatus due to the action of the delivery flapper 33.

Figure 12:
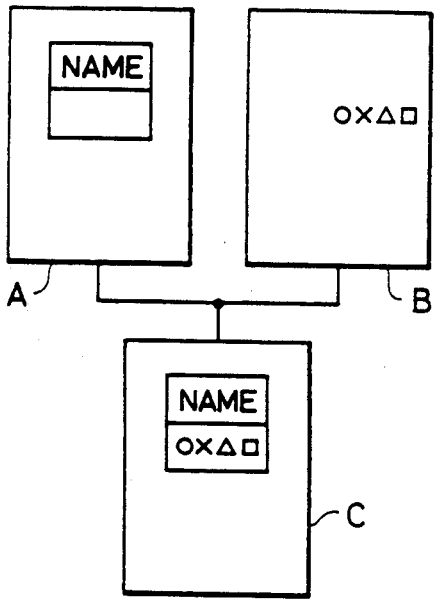
Figure 14:
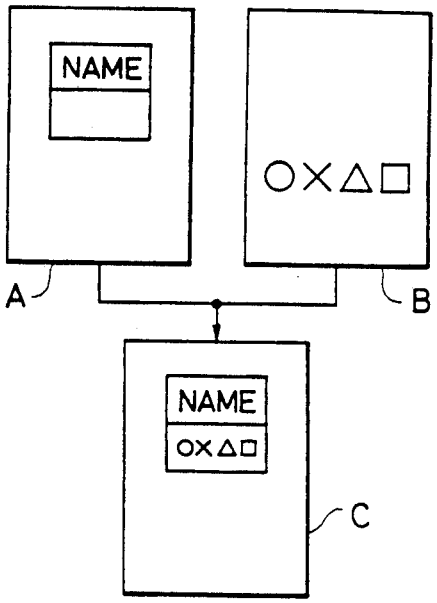

In this way, as shown in FIG. 12, for example, the document can be easily made by performing a multiple copy operation assuming that the original A is in the form of a document and the original B is a paper filled with necessary data.

Figures 1, 13:
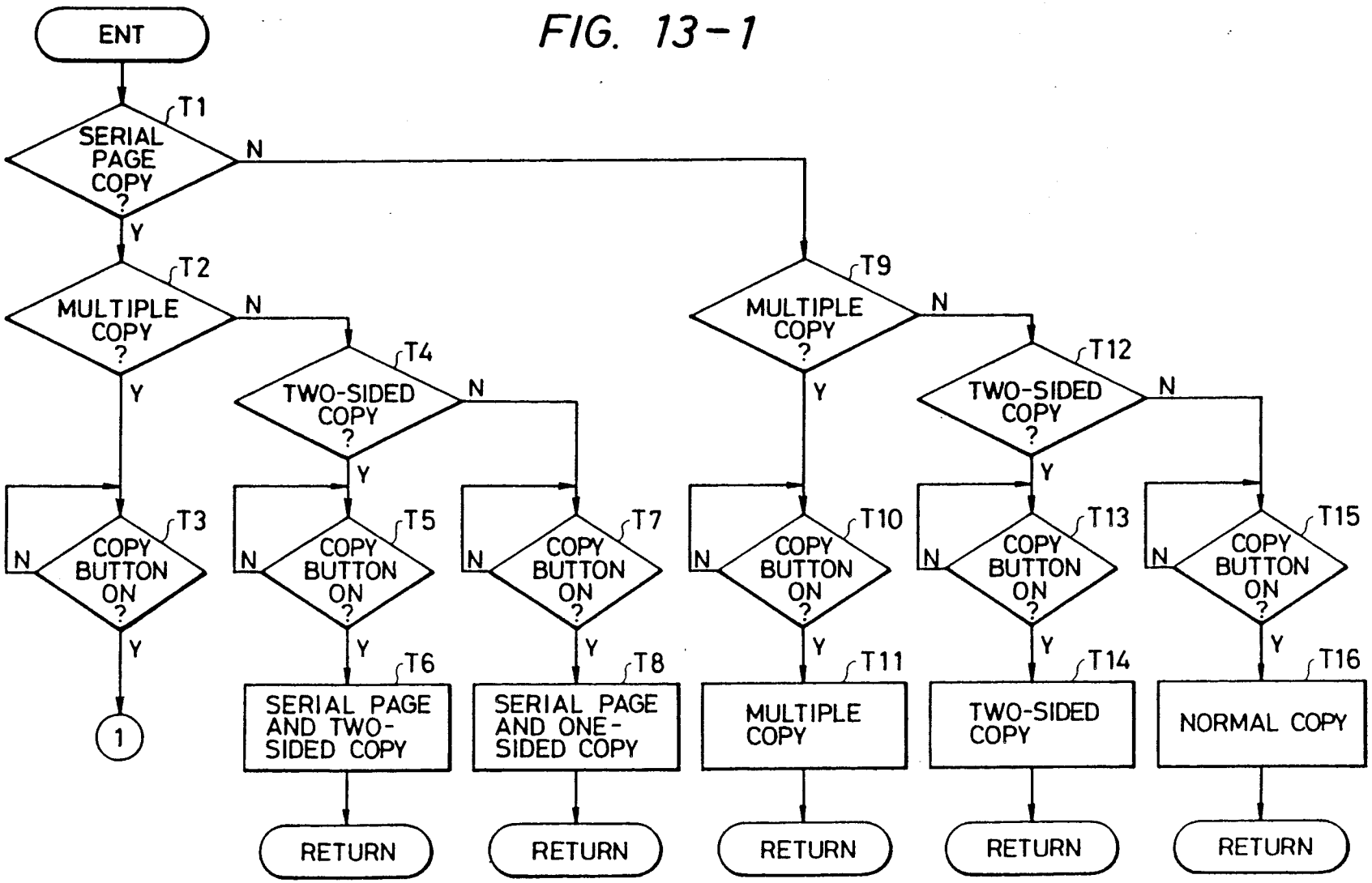
Figures 2, 13:
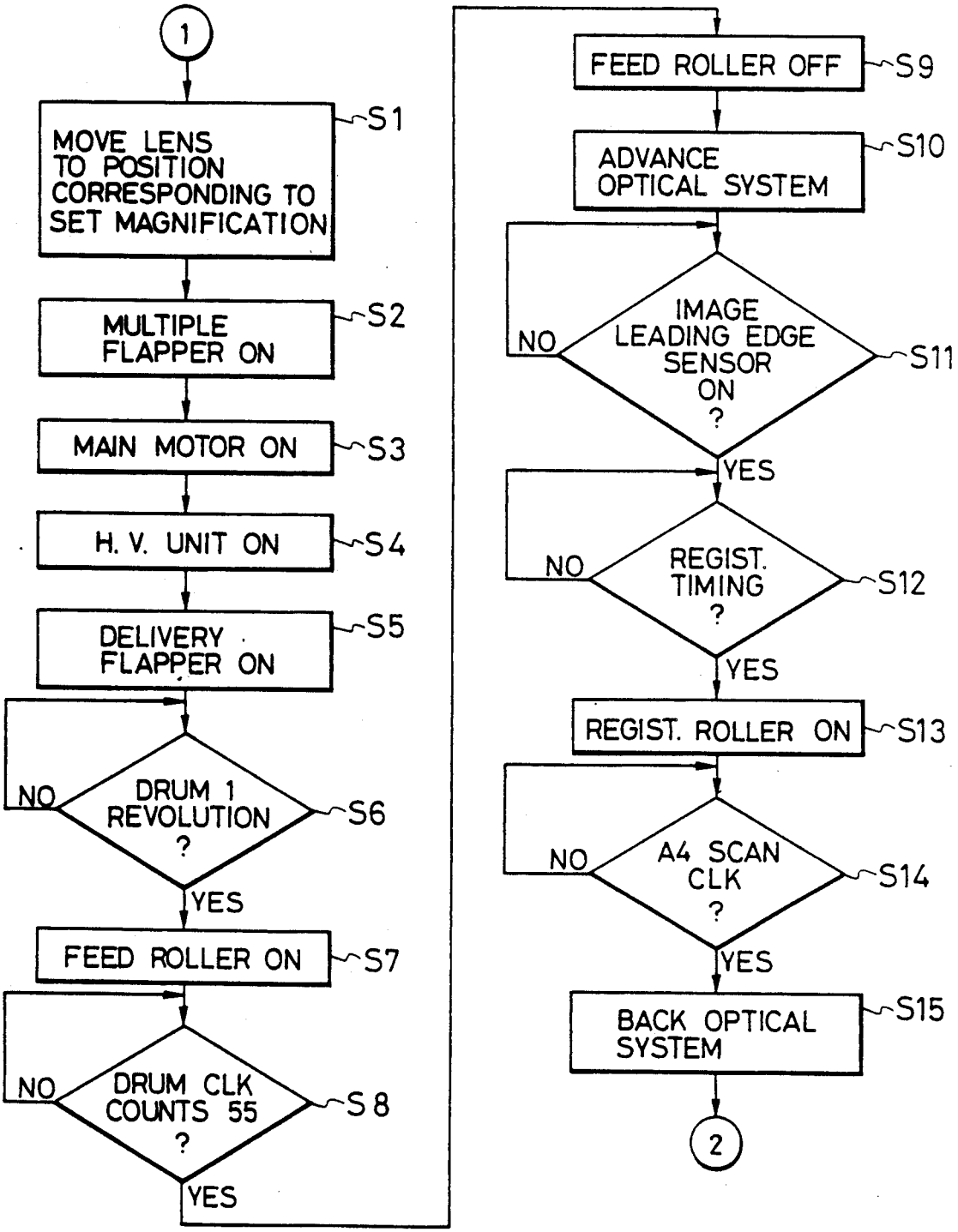
Figures 3, 13:
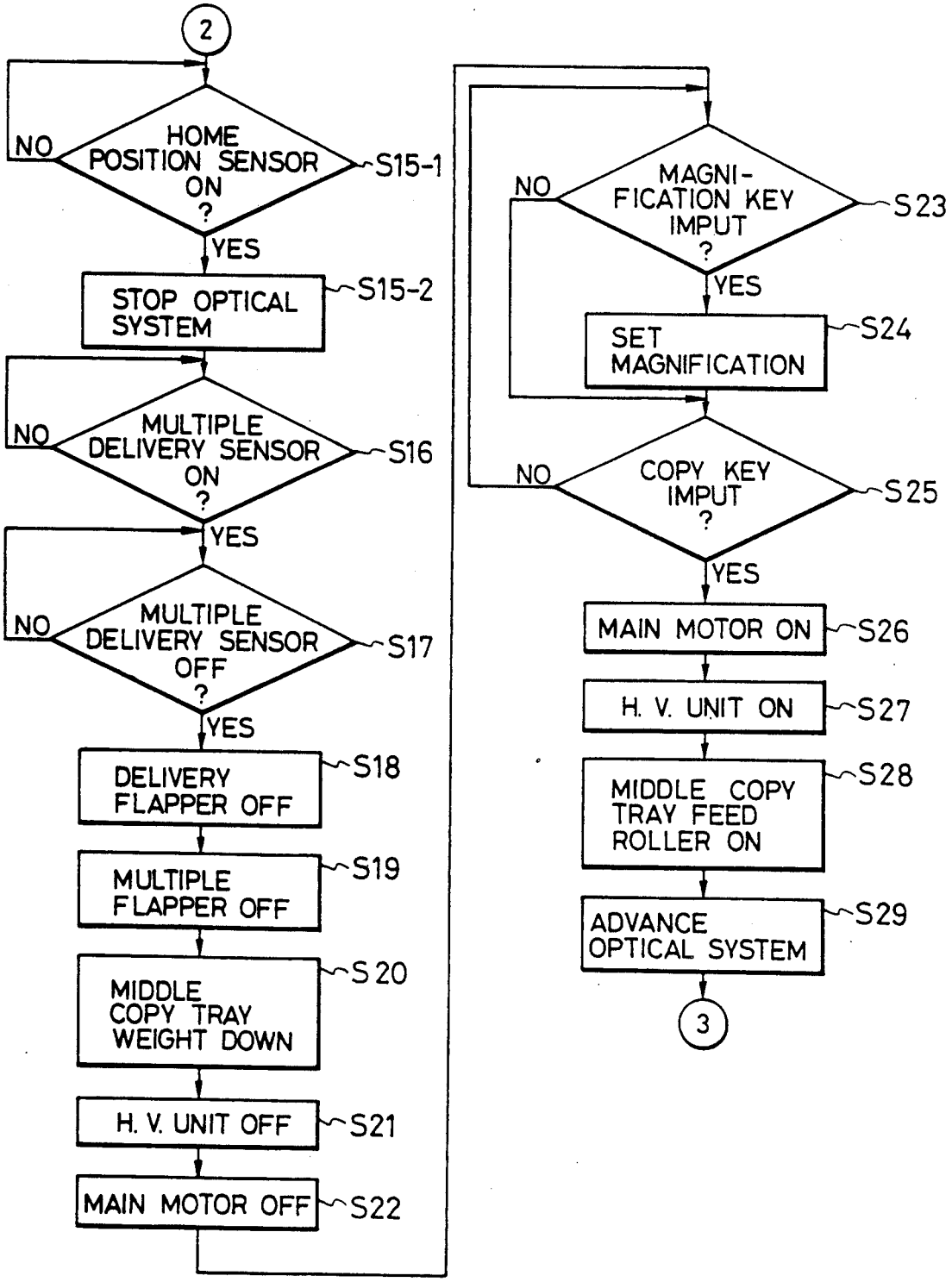
Figures 4, 13:
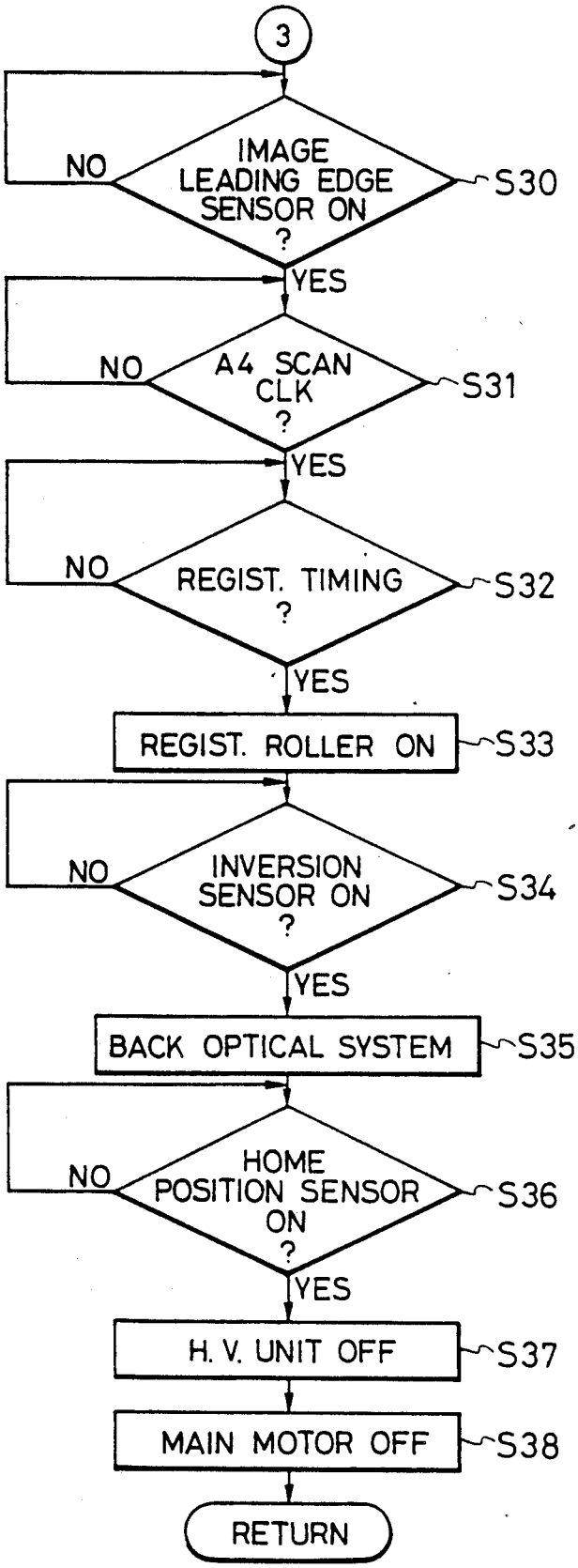

The case where respective pages are independently copied with variable magnifications in the serial page copy mode will then be described. Since FIG. 13-1 is substantially the same as FIG. 4-1 of the foregoing embodiment, its description is omitted.

When the copy key 117 was turned on, the zoom lens is moved to the position corresponding to the set magnification and the multiple flapper 52 is turned on, namely, the flapper 52 is lifted up, thereby allowing the transfer paper to flow to the conveying path 57-2 (steps S1, S2). Then, the main motor 3 is turned on, the high voltage unit 2 is turned on, and the delivery flapper 33 is turned on, that is, the flapper 33 is lifted up, thereby allowing the transfer paper to flow to the middle copy tray side (steps S3 to S5). The drum 1 is rotated once and the preprocess is performed. Upon completion of the preprocess, the feed roller of the cassette selected is turned on (steps S6, S7). Thus, the feed roller rotates and the transfer paper is fed to the registration roller 15. At this time, clock pulses are counted by the counter (not shown). When the counter indicates a count value corresponding to the registration position, the feed roller is turned off (steps S8, S9). During this period of time, the transfer paper reaches the registration position. The optical system is advanced by turning on the optical system motor (not shown) synchronously with evening off the feed roller (step S10). When the optical system moved to the position of the image leading edge sensor 21 and the sensor 21 is turned on, the apparatus waits for the registration timing by way of the timer in a manner such that the leading edge of the image formed on the drum 1 coincides with the front edge of the transfer paper. After an expiration of a predetermined period of time, the registration roller 15 is turned on, thereby allowing the transfer paper to come into contact with the drum 1 (steps S11 to S13). When the optical system is further advanced and the clock pulses (encoder pulses of the optical system motor) corresponding to the length in the lateral direction of the A4 size are counted, the optical system is moved backward (steps S14, S15). When the optical system is moved backward and the home position sensor 22 is turned on, the optical system motor is turned off to stop the optical system (steps S15-1, S15-2). Thereafter, the image of the original A is copied and the transfer paper is allowed to pass through the conveying paths 57 and 57-2 by the delivery flapper 33 and multiple flapper 52 and is loaded in the middle tray 59. When the multiple delivery sensor 24 is turned on and is then turned off within a predetermined period of time and it is confirmed that the transfer paper was loaded in the middle tray 59, the delivery flapper 33 is turned off, namely, the flapper 33 is put down and the multiple flapper 52 is turned off, that is, the flapper 52 is put down (steps S16 to S19). Then, the middle copy tray weight 53 is put on the transfer paper loaded in the middle tray 59 (step S20) and the high voltage unit 2 is turned off (step S21) and the main motor 3 is turned off (step S22). In this way, the copy of the original A is completed.

Subsequently, the apparatus waits for the inputting of the magnification keys such as the direct copy key 107, standard size magnification key 106, zoom key 104, automatic magnification key 105 etc. When one of those magnification keys is pressed, the magnification corresponding to this key is newly set (steps S23, S24).

A check is then made to see if the copy start key was pressed or not (step S25). If the copy start key was pressed, the main motor 3 is turned on and the high voltage unit 2 is turned on (steps S26, S27). The middle copy tray feed roller is turned on for allowing the transfer papers to be led one by one from the bottom to the conveying path 58, then the copy of the original B is started (step S28).

The transfer paper is allowed to wait at the position of the registration roller 15. The optical system is again advanced (step S29) and when the image leading edge sensor 21 is turned on, the clock pulses corresponding to the length in the lateral direciton of the A4 size are counted. After completion of the counting of the clock pulses as much as the A4 size, a predetermined period of time (150 msec in this embodiment) is timed by the timer (not shown), thereby matching the registration timing (steps S30 to S32). The registration roller 15 is turned on and the image of the original B is overlappingly copied on the paper on which the image of the original A has alredy been copied (step S33). When the optical system further advances and the inversion sensor 25 is turned on, the optical system is moved backward (steps S34, S35), thereby returning the optical system to the home position. When the sensor 22 is turned on, the high voltage unit 2 is turned off and the main motor 3 is turned off (steps S36 to S38). The transfer paper on which the images of the original A and B were copied is delivered to the outside (sorter 400) of the apparatus due to the action of the delivery flapper 33.

On one hand, it is also possible to read the size of the original by prescanning the original using an image sensor such as a CCD or the like in a part of the optical system and to automatically reduce or enlarge each original in in accordance with the size of the copy paper designated. In the apparatus whereby an original is exposed and scanned and the image is photoelectrically read by means of an image sensor, the image sensor for reading the image may be commonly used as a sensor to detect the size of the original.

In addition, it is also possible to adopt a constitution such that a mode key to select whether or not the magnifications of the originals A and B are made different is provided and when the originals A and B are copied with the same magnification, the apparatus is not temporarily stopped after completion of the copy of the original A.

Also, if the copy magnifications of both of the originals A and B can be preset, the work efficiency can be further improved.

Next, the controls to align the binding margin positions of the front and back surfaces of a recording paper on one of the right and left sides thereof when the two-sided copy is performed in the serial page copy mode will be described.

Figures 1, 15:
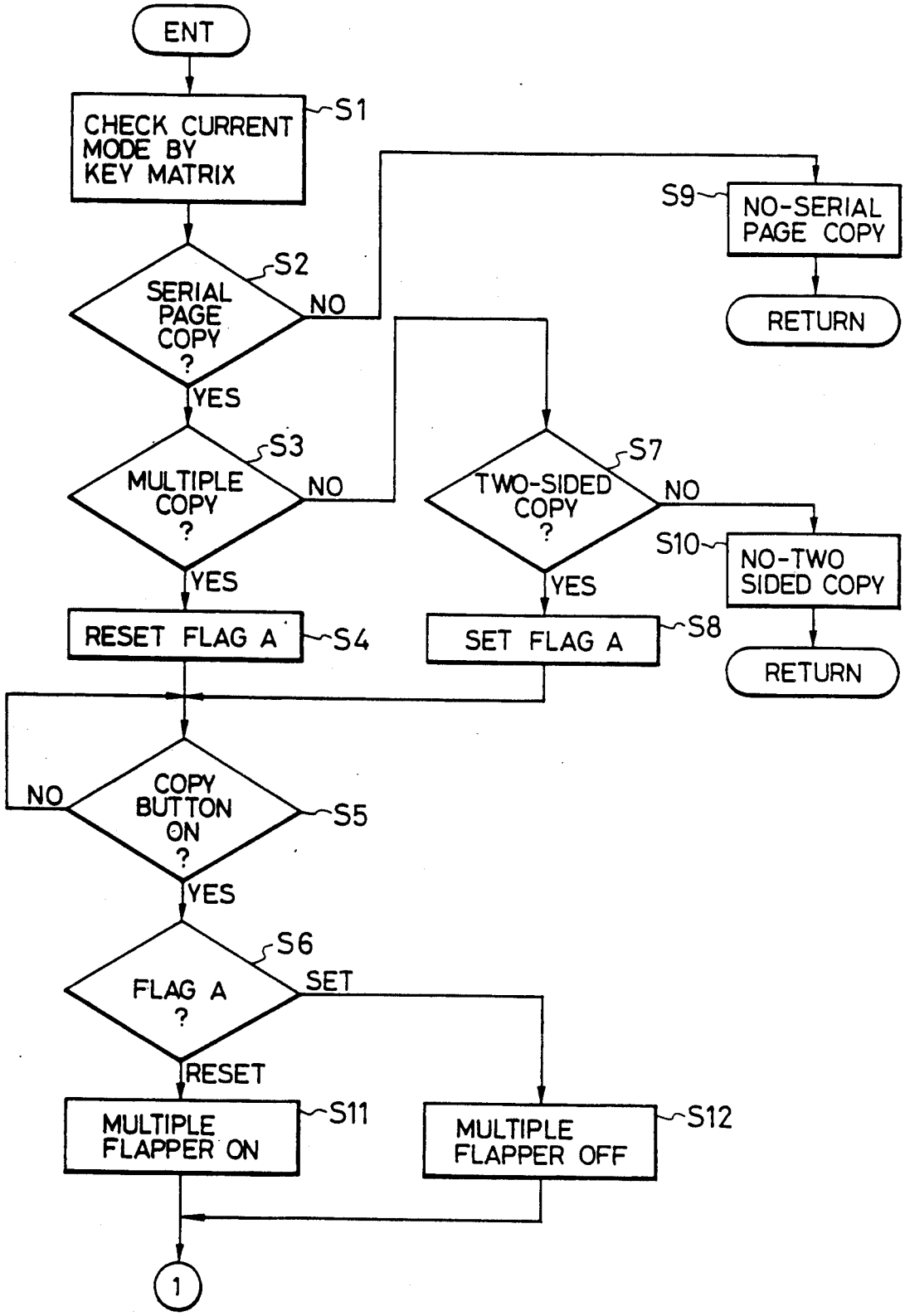
Figures 2, 15:
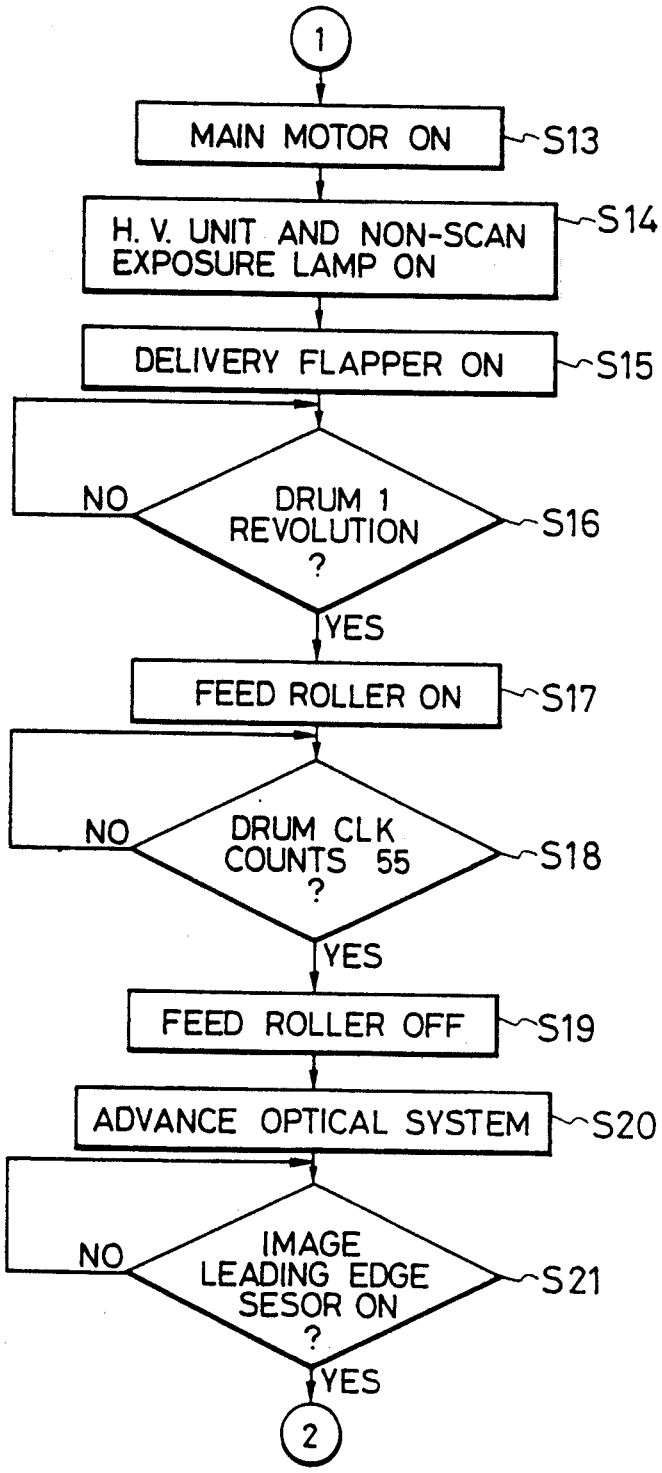
Figures 3, 15:
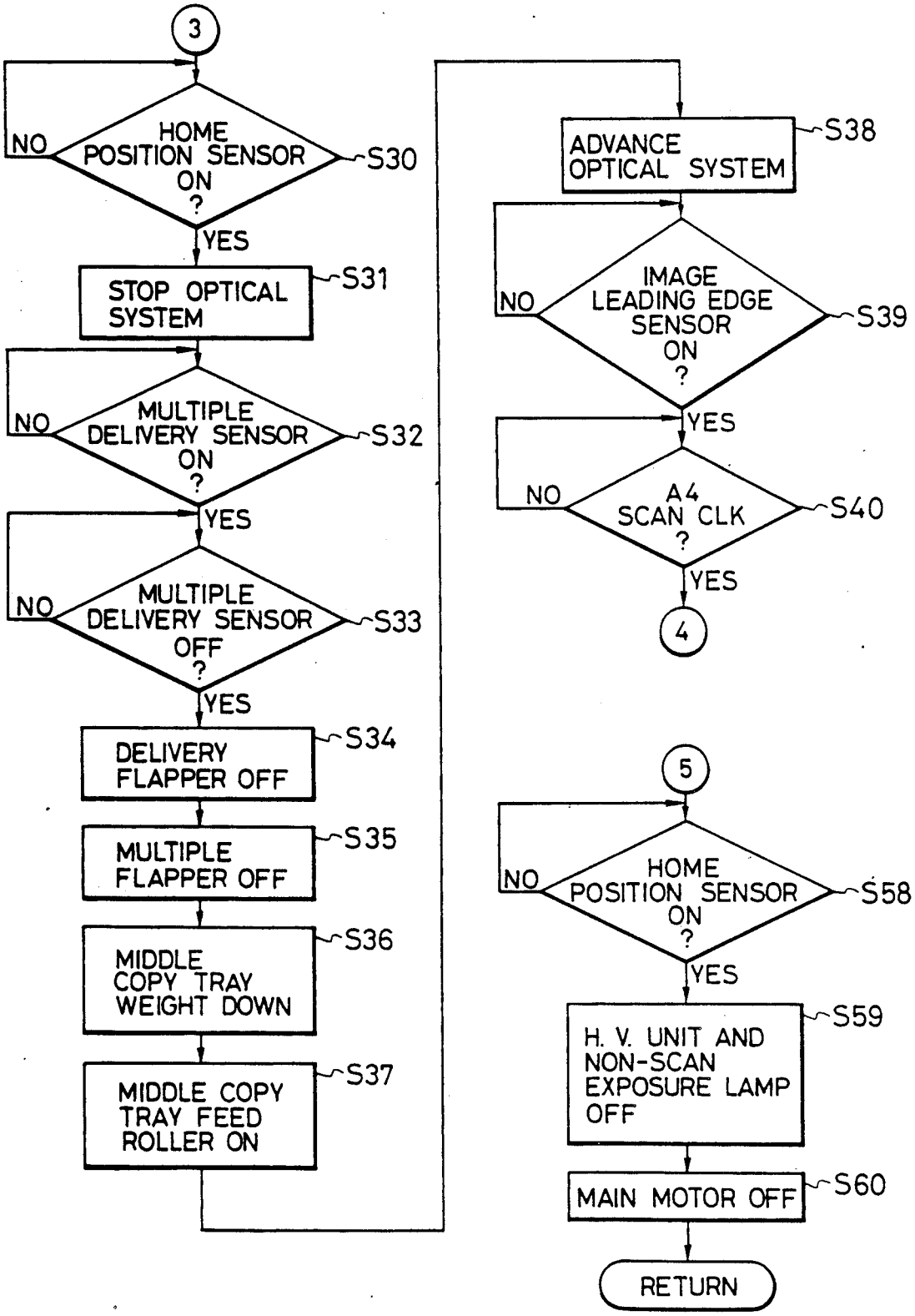
Figures 4, 15:
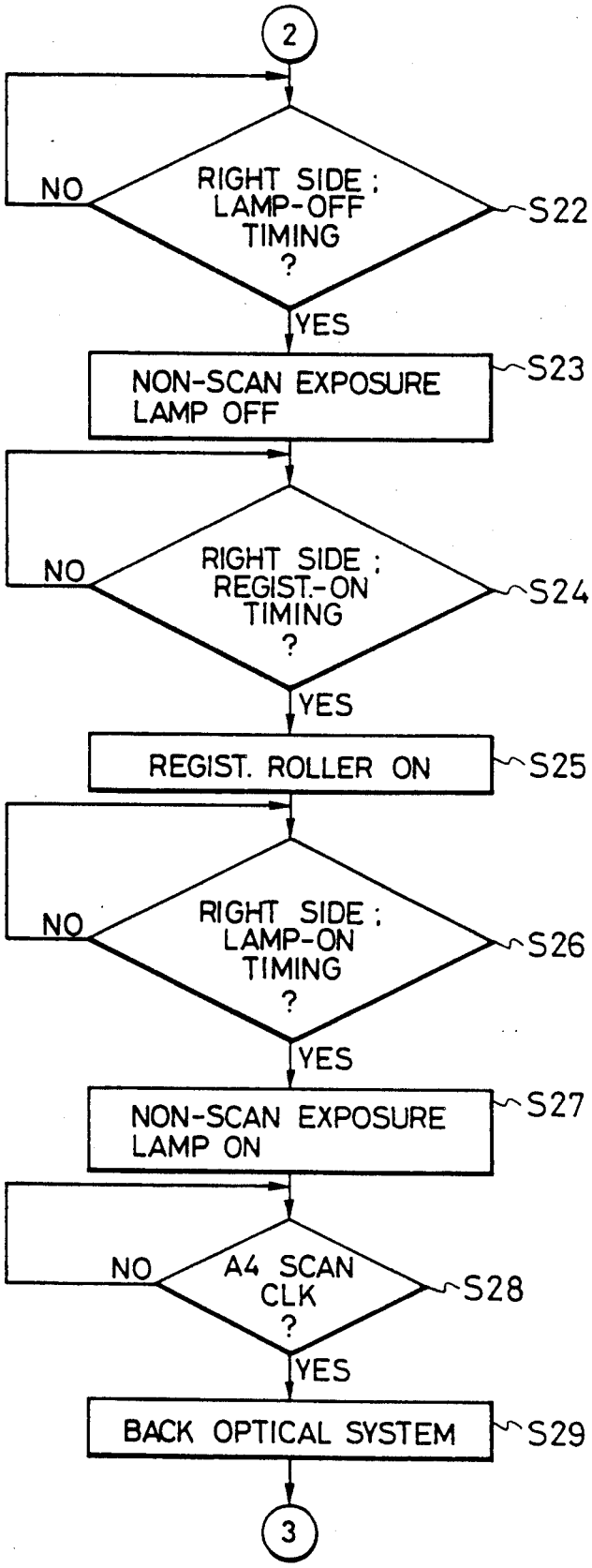
Figures 5, 15:
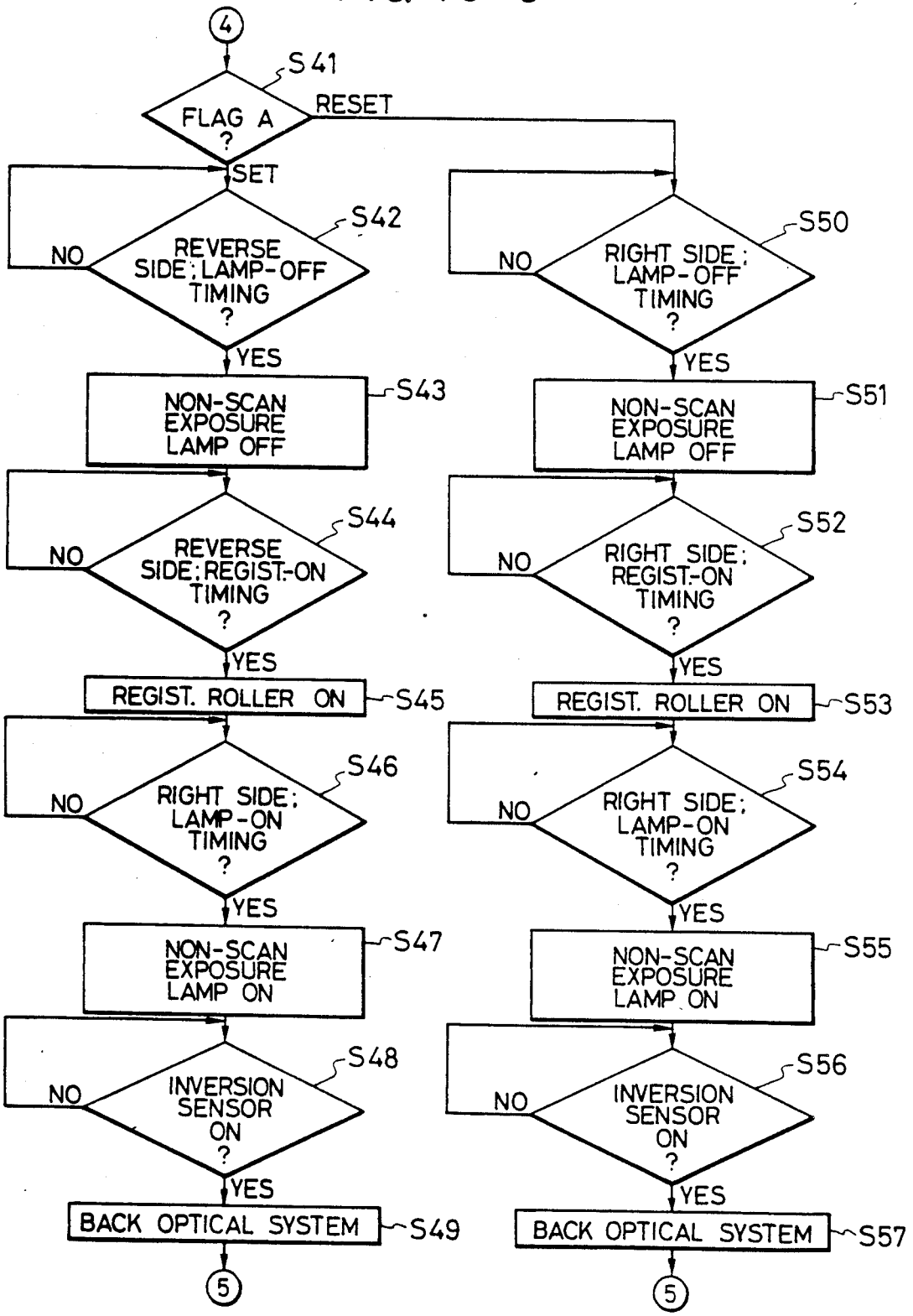

In FIGS. 15-1 to 15-4, a check is first made to see which key is pressed at present by way of a well-known key matrix (step S1). A check is made to see if serial page copy key 103 was pressed, the serial page copy display 128 is lit and a check is made to see if the multiply copy mode was set or not (step S3). If it was set (namely, the * 1 * keys were pressed), a flag A indicative of the multiple copy mode or not is reset (step S4). The apparatus waits until the copy start button 117 is pressed (step S5). Unless the serial page copy key 103 is pressed in step S2, the copy process in a copy mode other than the serial page copy mode is executed (step S9). Unless the multiple copy mode is set in step S3, a check is made to see if the two-sided copy mode was set or not (step S7). If it was set, the flag A is set (step S8) and the apparatus waits until the copy button 117 is pressed (step S5). Unless the two-sided copy mode is set, the copy process in a copy mode other than the two-sided copy mode is executed (step S10). When the copy key 117 is turned on, in the case where the flag A is reset, the multiple flapper 52 is turned on, namely, the flapper 52 is lifted up, thereby allowing the transfer paper to flow to the conveying path 57-2. On the contrary, in the case where the flag A is set, the multiple flapper 52 is turned off, namely, the flapper 52 is put down, thereby allowing the transfer paper to flow to the conveying path 57-1. The main motor 3 is then turned on, the high voltage unit 2 is turned on, all of the non-scan exposure lamps 60 are lit, and the delivery flapper 33 is turned on, namely, the flapper 33 is lifted up, thereby allowing the transfer paper to flow to the middle copy tray side. (Steps S11 to S15).

The drum 1 is rotated once and the preprocess is performed. After completion of the preprocess, the feed roller of the cassette selected is turned on (steps S16, S17). Thus, the feed roller rotates and the transfer paper is fed to the registration roller 15. At this time, a clock pulse is counted by the counter (not shown). When the counter indicates a count value (55 in this embodiment) corresponding to the period of time when the transfer paper is fed to the registration position, the feed roller is turned off (steps S18, S19). The optical system is advanced by turning on the optical system motor (not shown) synchronously with the turn-off of the feed roller (step S20). When the optical system advances to the position of the image leading edge sensor 21 and the sensor 21 is turned on (step S21), the apparatus then waits for the timing of the front surface copy to turn off the lighting non-surface exposure lamp 60 in order to prevent an unnecessary amount of toner from being deposited on the drum (step S22). If it is the time to turn off the lamp 60, it is turned off (step S23) and the apparatus waits for the timing of the front surface copy to turn on the registration clutch (step S24). Then, the registration roller 15 is turned on (step S25).

The registration roller is turned on at the time when the leading edge of the image formed on the drum 1 coincides with the front edge of the transfer paper. In the case where the serial page copy mode and the two-sided copy mode are set, the back surface is copied when the leading edge of the image formed on the drum 1 coincides with the position in consideration of the binding margin amount of the transfer paper. Next, the apparatus waits for the timing when the necessary latent image of the original A is formed on the drum and all of the lamps 60 are turned off (step S26). When it is the time to light all of the lamps 60, they are lit (step S27). A check is made to see if the optical system scanned the region corresponding to the A4 size of the original or not (step S28). If it scanned, the optical system is moved backward (step S29).

The timings to turn on and off the lamp 60 differs in dependence on the size of paper and on the amount of binding margin. These timings are controlled so as to prevent the deposition of an unnecessary amount of toner on the drum surface or the formation of images other than the content of the original on the paper.

When the optical system moves backward and the home position sensor 22 is turned on, the optical system motor is turned off to stop the optical system (steps S30, S31). Thereafter, the image of the original A is copied and the transfer paper is allowed to pass through the conveying paths 57 and 57-2 in case when the apparatus operates in the multiple copy mode or through the conveying paths 57 and 57-1 in case the apparatus operates in the two-sided copy mode by way of the delivery flapper 33 and multiple flapper 52 and is loaded in the middle copy tray 59. When the multiple delivery sensor 24 is turned on and is then turned off within a predetermined period of time and it is confirmed that the transfer paper was loaded in the middle tray 59, the delivery flapper 33 is turned off, namely, the flapper 33 is put down and the multiple flapper 52 is off, that is, the flapper 52 is put down (in the multiple copy mode) (steps S32 to S35). Then, the middle copy tray weight 53 is put on the transfer paper loaded in the middle tray 59 (step S36) and the middle tray feed roller is turned on, thereby allowing the transfer papers to be led one by one from the bottom to the conveying path 58 (step S37). The transfer paper is allowed to wait at the position of the registration roller 15. The optical system is again advanced (step S38). When the image leading edge sensor 21 is turnd on (step S39), the clock pulses corresponding to the length in the lateral direction of the A4 size are counted. After completion of the counting of the clocks as much as the A4 size (step S40), a predetermined period of time (150 msec in this embodiment) is timed by the timer (not shown) and a check is made to see if the flag A was set or not (step S41). If the flag A was set, namely, if the two-sided copy mode was set, the apparatus then waits for the timing to turn off the lamp 60 at the time of the back surface copy in consideration of the binding margin amount (step S42). That is, in case of the back surface copy, the timing to turn off the lamp 60 is delayed so that the binding margin position comes on the right side of the recording paper.

If it comes the time to turn off the lamp 60, the lamp 60 is turned off (step S43) and the apparatus waits for the timing to turn on the registration roller 15 at the time of the back surface copy in consideration of the binding margin amount (step S44). Namely, in case of the back surface copy, the registraion timing is delayed so that the binding margin position comes on the right side of the recording paper. By turning on the registration roller 15, the transfer paper is allowed to come into contact with the drum and the image of the original B is copied on the back surface of the paper on which the image of the original A has already been copied (step S45).

Next, the latent image of the original B is formed on the drum surface and the apparatus waits for the timing to light the lamp 60 in the normal copy mode (front surface copy) (step S46). Namely, the binding margin is formed by the lamp 60.

At the non-scan exposure timing, all of the non-scan exposure lamps 60 are lit (step S47) and the apparatus waits until the inversion sensor 25 is turned on (step S48). If the sensor 25 was turned on, the optical system is moved backward (step S49) and the optical system is returned to the home position.

On one hand, if the flag A was reset in step S41, the apparatus waits for the timing to turn off the lamp 60 at the time of the front surface copy (step S50).

If it comes the time to turn off the lamp 60, the lamp 60 is turned off (step S51) and the apparatus waits for the timing to turn on the registration roller 15 at the time of the front surface copy. By turning on the registration roller 15, the transfer paper comes into contact with the drum and the image of the original B is overlappingly copied on the paper on which the image of the original A has already been copied (steps S52, S53).

Subsequently, the latent image of the original B is formed on the drum surface and the apparatus waits for the timing to light on the lamp 60 at the time of the front surface copy (step S54).

At the non-scan exposure timing, all of the lamps 60 are lit (step S55) and the apparatus waits until the inversion sensor 25 is turned on (step S56). If the sensor 25 was turned on, the optical system is moved backward (step S57) and is returned to the home position. When the home position sensor 22 was turned on, the high voltage unit 2 is turned off, the lamp 60 is turned off, and the main motor 3 is turned off (steps S58 to S60). The transfer paper on which the images of the originals A and B were copied is delivered to the outside (sorter 400) of the apparatus due to the action of the delivery flapper 33.

Figure 16:
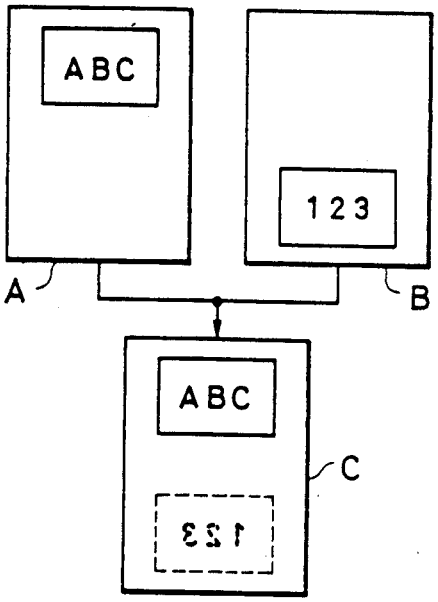

In this manner, the binding margins of the images on the front and back surfaces of the recording paper can be aligned on one of the right and left sides of the paper as illustrated in FIG. 16.

On the other hand, the registration timing may be made early such that the binding margin is formed on the left side of the recording paper when the image is copied on the front surface.

In addition, the binding margin amounts of the front and back surfaces can be also adjusted by making the registration timing variable using a key of the operating section, or the like.

The masking function in the serial page copy mode will now be explained.

Figures 1, 17:
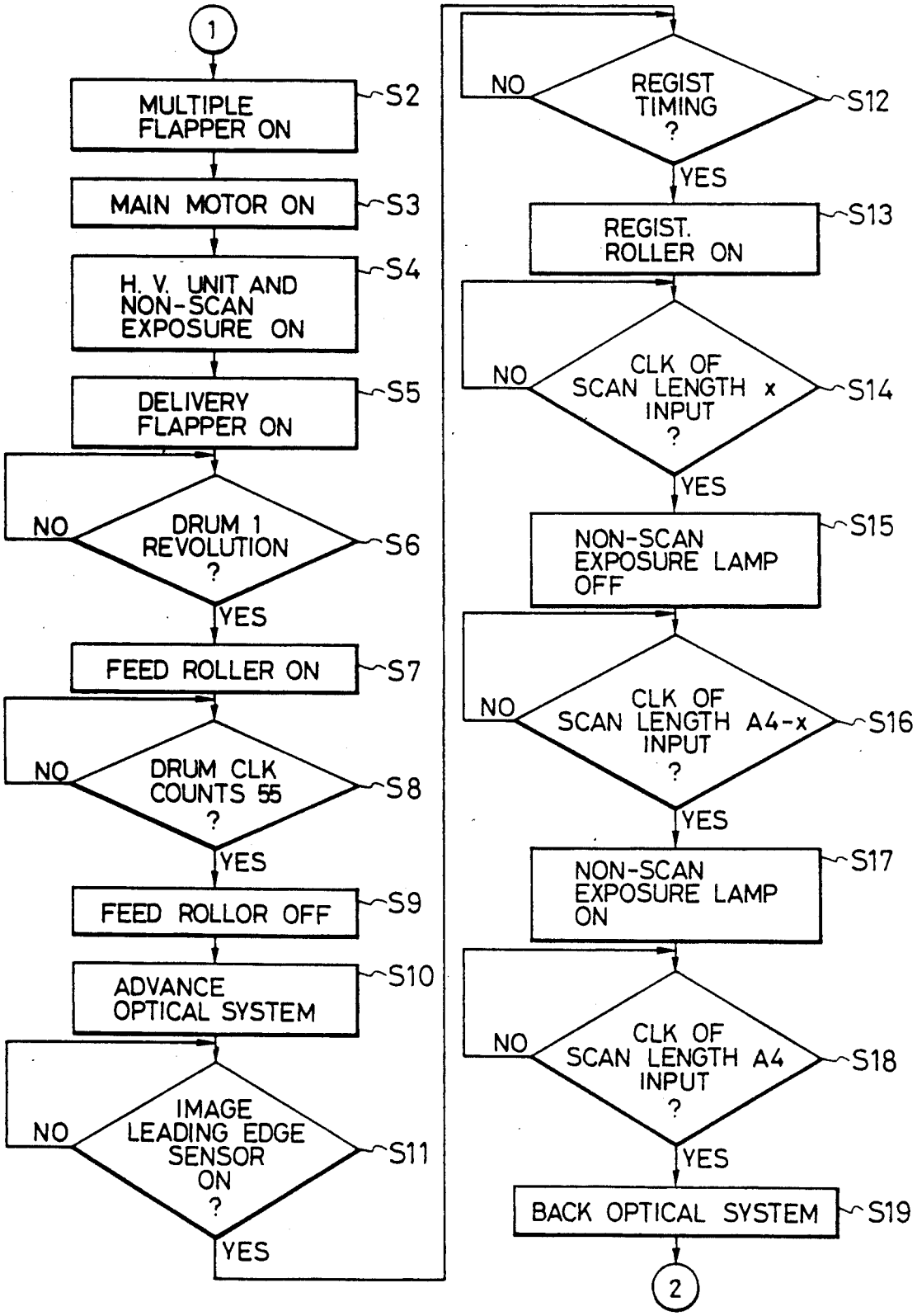
Figures 2, 17:
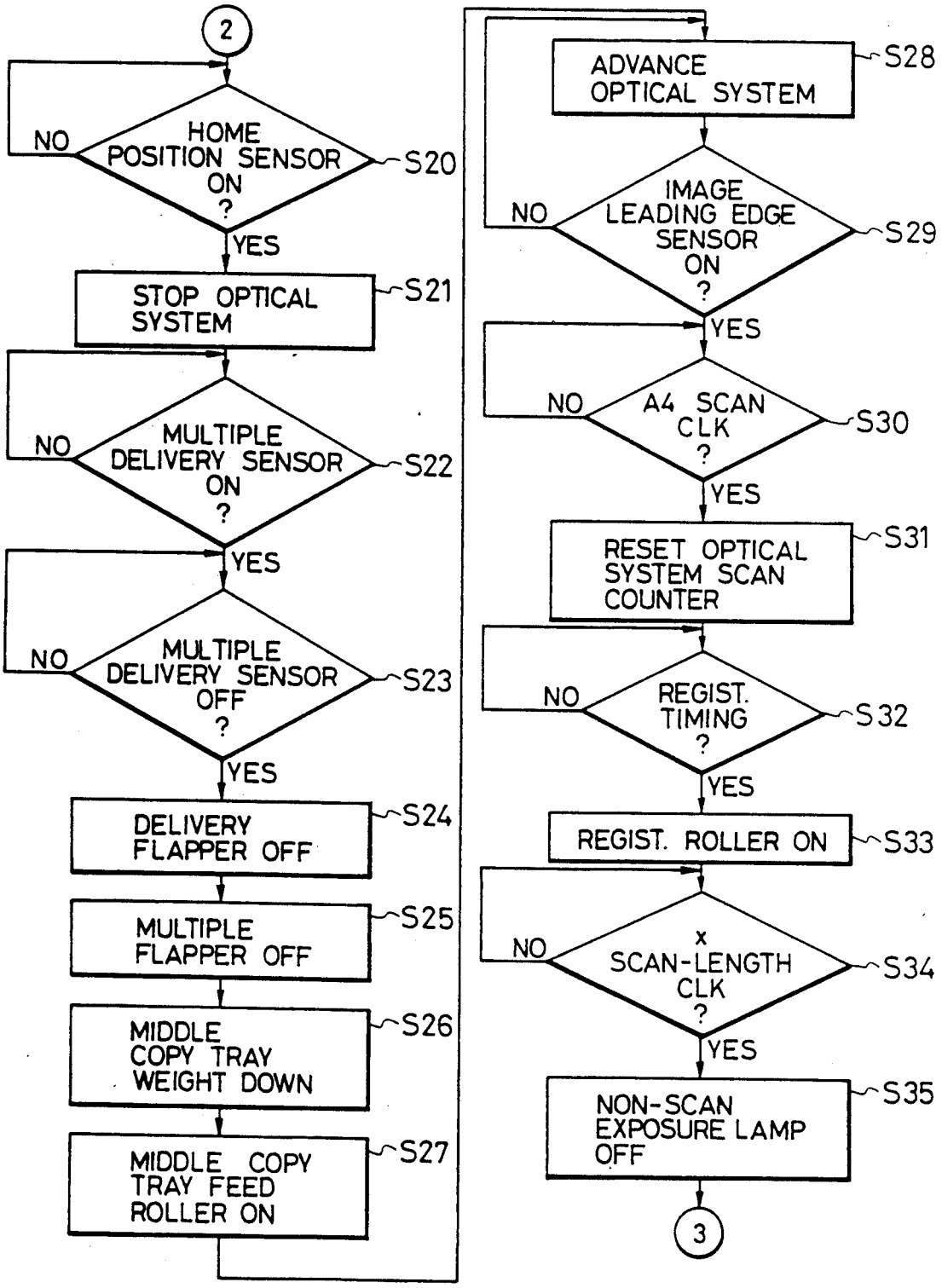
Figures 3, 17:
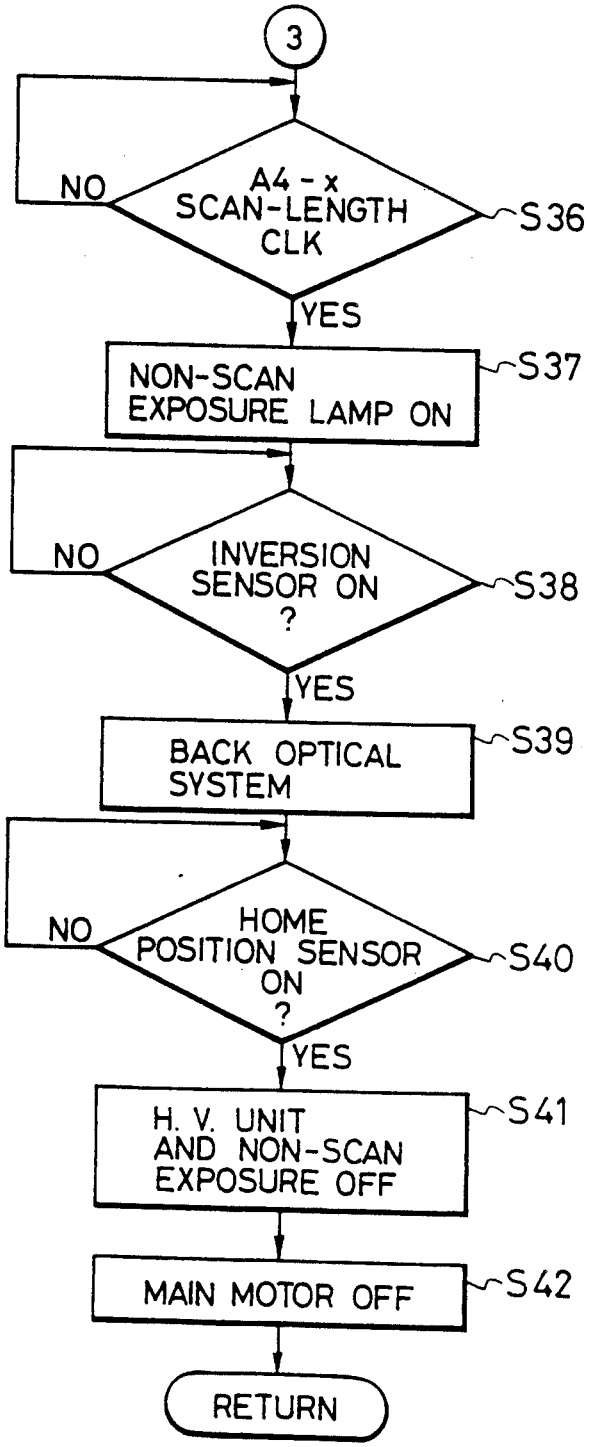

In this embodiment, the flowchart shown in FIG. 4-1 can be applied; therefore, its description is omitted here. With respect to FIGS. 17-1 through 17-3, if the copy start key 117 is turned on, the multiple flapper 52 is turned on, namely, the flapper 52 is lifted up, thereby allowing the transfer paper to flow to the conveying path 57-2. The main motor 3 is turned on, the high voltage unit 2 is turned on, all of the non-scan exposure lamps 60 are lit, and the delivery flapper 33 is turned on, namely, the flapper 33 is lifted up, thereby permitting the transfer paper to flow to the middle copy tray side (steps S2 to S5). The drum 1 is rotated once and the preprocess is performed. After completion of the preprocess, the feed roller of the cassette selected is turned on (steps S6, S7). Thus, the feed roller rotates and the transfer paper is fed to the registration roller 15. At this time, a clock pulse is counted by the counter (not shown). When the counter indicates a count value (55 in this embodiment) corresponding to the period of time when the transfer paper is fed to the registration position, the feed roller is turned off (steps S8, S9). During this period of time, the transfer paper reaches the registration position. The optical system is advanced by turning on the optical system motor (not shown) synchronously with the turn-off of the roller (step S10). When the optical system moved to the position of the image leading edge sensor 21 and the sensor 21 is turned on, the apparatus waits for the registration timing by way of the timer such that the leading edge of the image formed on the drum 1 coincides with the front edge of the transfer paper. After an expiration of a predetermined period of time, the registration roller 15 is turned on, thereby allowing the transfer paper to come into contact with the drum 1 (steps S11 to S13).

Figure 18:
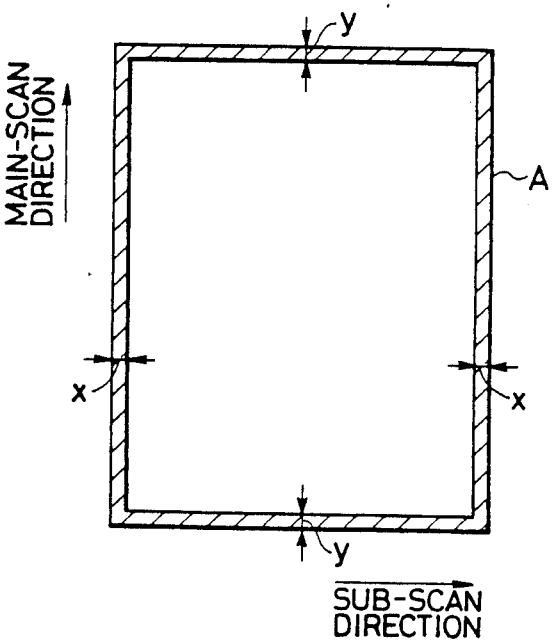
FIG. 18 is a diagram to explain the masking positions.

As shown in FIG. 18, when the optical system moved from the front edge of the original by only the masking amount x, the non-scan exposure lamp 60 is turned off in consideration of the masking amount y in the main-scan direction. When the optical system further advances and comes to the position the distance x before the rear edge of the original, all of the lamps 60 are lit. That is, after the image leading edge sensor was turned on, when the encoder pulses of the optical system motor are counted by the optical system scan counter (not shown) in correspondence to the masking amount x, the non-scan exposure lamps 60 excluding only the lamps corresponding to the masking position in the main-scan direction are turned off (steps S14, S15). After the encoder pulses (corresponding to the length derived by subtracting the x scan length from the scan length of the A4 size) were counted, all of the lamps 60 are lit (steps S16, S17). In this way, the hatched frame portions as shown in FIG. 18 are erased. When the optical system further advances and the clocks pulses (encoder pulses of the optical system motor) corresponding to the length in the lateral direction of the A4 size are counted, the optical system is moved backward (steps S18, S19). When the optical system is moved backward and the home position sensor 22 is turned on, the optical system motor is turned off to stop the optical system (steps S20, S21). Thereafter, the image of the original A is copied and the transfer paper is allowed to pass through the conveying paths 57 and 57-2 by way of the delivery flapper 33 and multiple flapper 52 and is loaded in the middle tray 59. When the multiple delivery sensor 24 is turned on an is then turned off within a predetermined period of time and it is confirmed that the transfer paper was loaded in the middle tray 59, the delivery flapper 33 is turned off, namely, the flapper 33 is put down and the multiple flapper 52 is turned off, that is, the flapper 52 is put down (steps S22 to S25). The middle copy tray weight 53 is put on the transfer paper loaded in the middle tray 59 (step S26) and the middle copy tray feed roller is turned on, thereby allowing the transfer papers to be led one by one from the bottom to the conveying path 58 (step S27). The transfer paper is allowed to wait at the position of the registration roller 15. The optical system is again advanced (step S28) and when the image leading edge sensor 21 is turned on, the clock pulses corresponding to the length in the lateral direction of the A4 size are counted. After the clock pulses as much as the A4 size were counted, the optical system scan counter is reset and restarts the counting. When a predetermined period of time (150 msec in this embodiment) is timed by the timer (not shown), thereby matching the registration timings (step S29 to S32). The registration roller 15 is turned on for allowing the transfer paper to be come into contact with the drum 1 (step S33). Similarly to the case described in conjunction with steps S14 to S17, the non-scan exposure lamp 60 is controlled for masking and the unnecessary portions are erased. At the same time, the image of the original B is overlappingly copied on the transfer paper on which the image of the original A has already been copied (steps S34 to S37). When the optical system further advanced and the inversion sensor 25 is turned on, the optical system is moved backward (steps S38, S39), thereby returning the optical system to the home position. When the home position sensor 22 is turned on, the high voltage unit 2 is turned off and the main motor 3 is turned off (steps S40 to S42). The transfer paper on which the images of the originals A and B were copied is delivered to the outside (sorter 400) of the apparatus due to the action of the delivery flapper 33.

The present invention is not limited to the foregoing embodiment but many modifications and variations are possible within the spirit and scope of the appended claims of the invention.

We claim:

1. An image forming apparatus comprising:

a platen for placing first and second originals side by side thereon;

scanning means for scanning said first and second originals placed on said platen side by side, wherein in a first scanning operation said scanning means moves in a first direction in order to scan said first original, and then moves in a second direction, and in a second scanning operation said scanning means moves the first direction in order to scan said second original;

image forming means for forming on a recording medium both a first latent image corresponding to the scanned first original and a second latent image corresponding to the scanned original;

developing means for developing said first and second latent images formed on said recording medium; and charge control means for, in the second scanning operation of said scanning means, causing a predetermined area on said recording medium corresponding to an area overlapping upon the first scanning operation to become a non-charge state prior to a development of the second latent image.

2. An image forming apparatus according to claim 1, wherein said scanning means starts the first scanning operation from a predetermined position and returns to the predetermined position after completion of the first scanning operation, and then said scanning means starts the second scanning operation from the predetermined position.

3. An image forming apparatus according to claim 1, wherein said charge control means includes a light applying means for applying a light to the predetermined area of said recording medium in order to cause said recording medium to become a non-charge state.

4. An image forming apparatus according to claim 3, wherein said light applying means applies the light to the predetermined area of said recording medium prior to formation of a latent image on said recording medium.

5. An image forming apparatus according to claim 1, further comprising counting means for counting a pulse, wherein a movement distance of said scanning means is controlled on the basis of a counted value of said counting means.

6. An image forming apparatus according to claim 5, wherein said charge control means is controlled on the basis of the counted value of said counting means.

7. An image forming apparatus according to claim 5, wherein said pulse is generated in synchronization with a movement of said scanning means.

8. An image forming apparatus according to claim 5, further comprising detecting means for detecting a position corresponding to a leading edge of said first original by means of said scanning means, wherein when said counting means counts a predetermined number of pulses during a first scanning operation after said detecting means detects the corresponding position, said scanning means is returned to a predetermined position.

9. An image forming apparatus according to claim 8, further comprising a timer for counting a predetermined time period and carrying means for carrying a transfer member, wherein when said timer counts the predetermined time period both after detection of the corresponding position by said detecting means in the first scanning operation and after said counting means counts the predetermined numbers of pulses after detection of the corresponding position by said detecting means in the second scanning operation, said carrying means carries said transfer member.

10. An image forming apparatus according to claim 1, further includes transfer means for transferring the first and second latent images developed by said developing means to the same sheet.

11. An image forming apparatus according to claim 1, further comprising transfer means for transferring the first and second latent images developed by said developing means to different sheets of recording medium.

12. An image forming apparatus according to claim 1, wherein said scanning means automatically starts the second scanning operation after completion of the first scanning operation.

* * * * *

UNITED STATES PATENT AND TRADEMARK OFFICE

CERTIFICATE OF CORRECTION

PATENT NO. : 4,999,674

DATED : March 12, 1991

INVENTOR(S) : Masanori Miyata

It is certified that error appears in the above-identified patent and that said Letters Patent is hereby corrected as shown below:

[57] At Abstract:

Line 13, "an" should read --the--; and "the" (first occurrence) should read --an--.

In the Drawings:

[Sheet 22] At Figure 13-3:

"IMPUT" should read --INPUT--.

[Sheet 25] At Figure 15-2:

"SESOR" should read --SENSOR--.

COLUMN 1:

Line 45, "blank" should read --blank space--.
Line 46, "either" should be deleted.
Line 53, "surface front" should read --front surface--.

UNITED STATES PATENT AND TRADEMARK OFFICE

CERTIFICATE OF CORRECTION

PATENT NO. : 4,999,674 Page 2 of 7

DATED : March 12, 1991

INVENTOR(S) : Masanori Miyata

It is certified that error appears in the above-identified patent and that said Letters Patent is hereby corrected as shown below:

COLUMN 2:

Line 1, "apparatus" should read --apparatuses--.
Line 11, "judgement" should read --judgment--; and "one" should be deleted.

COLUMN 3:

Line 1, "tion, and in" should read --tion. In--.
Line 7, "imaged" should read --images--.
Line 9, "means for," should read --means,--.
Line 65, "are" should read --is--.

COLUMN 4:

Line 7, "preventing" should read --prevents--.
Line 52, "on" should read --it on--.
Line 61, "of" should read --the apparatus operates in--.
Line 65, "the appara-" should be deleted.
Line 66, "tus operates in" should read --of--.

UNITED STATES PATENT AND TRADEMARK OFFICE

CERTIFICATE OF CORRECTION

PATENT NO. : 4,999,674

DATED : March 12, 1991

INVENTOR(S) : Masanori Miyata

It is certified that error appears in the above-identified patent and that said Letters Patent is hereby corrected as shown below:

COLUMN 5:

Line 55, "ten-key" should read --ten key set--.

COLUMN 6:

Line 14, "and" should read --or-.
Line 27, "display 122" should read --display 123--.

COLUMN 7:

Line 23, "then" should read --now--.
Line 36, "in" should be deleted.
Line 42, "then" should read --now--.

COLUMN 10:

Line 27, "an" should read --and--.
Line 39, "copying" should read --for copying--.
Line 41, "copying" should read --for copying--.
Line 43, "copying" should read --for copying--.

UNITED STATES PATENT AND TRADEMARK OFFICE

CERTIFICATE OF CORRECTION

PATENT NO. : 4,999,674 Page 4 of 7

DATED : March 12, 1991

INVENTOR(S) : Masanori Miyata

It is certified that error appears in the above-identified patent and that said Letters Patent is hereby corrected as shown below:

COLUMN 10 (Continued):

Line 45, "copying" should read --for copying--.

COLUMN 11:

Line 7, "on" should read --to exist on--.
Line 10, "then" should read --now--.
Line 19, "these" should read --that--.
Line 59, "other copy mode" should read --a copy mode other--.
Line 62, "other copy mode" should read --a copy mode other--.
Line 64, "other copy mode" should read --a copy mode other--.

COLUMN 12

Line 29, "position, the" should read --position. The--.
Line 38, "be" should be deleted.

UNITED STATES PATENT AND TRADEMARK OFFICE

CERTIFICATE OF CORRECTION

PATENT NO. : 4,999,674 Page 5 of 7

DATED : March 12, 1991

INVENTOR(S) : Masanori Miyata

It is certified that error appears in the above-identified patent and that said Letters Patent is hereby corrected as shown below:

COLUMN 13:

Line 60, "(asteriak)" should read --(asterisk)--.
Line 62, "descriminates" should read --discriminates--.

COLUMN 14:

Line 58, "a" should be deleted.

COLUMN 15:

Line 53, "clockpulses" should read --clock pulses--.
Line 55, "clockpulses" should read --clock pulses--.
Line 62, "registratior" should read --registration--.

COLUMN 16:

Line 29, "then" should read --now--.
Line 53, "evening" should read --turning--.

UNITED STATES PATENT AND TRADEMARK OFFICE

CERTIFICATE OF CORRECTION

PATENT NO. : 4,999,674 Page 6 of 7

DATED : March 12, 1991

INVENTOR(S) : Masanori Miyata

It is certified that error appears in the above-identified patent and that said Letters Patent is hereby corrected as shown below:

COLUMN 17:

Line 44, "alredy" should read --already--.
Line 48, "sensor" should read --home position sensor--.
Line 58, "in" (second occurrence) should be deleted.

COLUMN 18:

Line 16, "ply" should read --ple--.

COLUMN 19:

Line 14, "differs" should read --differ--.
Line 25, "when" should be deleted.
Line 45, "turnd" should read --turned--.
Line 48, "clocks" should read --clock pulses--.

COLUMN 20:

Line 29, "on" should be deleted.

UNITED STATES PATENT AND TRADEMARK OFFICE

CERTIFICATE OF CORRECTION

PATENT NO. : 4,999,674 Page 7 of 7

DATED : March 12, 1991

INVENTOR(S) : Masanori Miyata

It is certified that error appears in the above-identified patent and that said Letters Patent is hereby corrected as shown below:

COLUMN 21:

Line 14, "moved" should read --moves--.
Line 23, "moved" should read --moves--.
Line 42, "clocks" should read --clock--.
Line 54, "an" should read --and--.

COLUMN 22:

Line 16, "advanced" should read --advances--.
Line 39, "the" should read --in the--.
Line 44, "scanned" should read --scanned second--.

COLUMN 24:

Line 6, "numbers" should read --number--.

Signed and Sealed this

Twenty-third Day of June, 1998

Bruce Lehman

*Attest:*

BRUCE LEHMAN

*Attesting Officer*

*Commissioner of Patents and Trademarks*